US011732209B2

(12) United States Patent
E et al.

(10) Patent No.: US 11,732,209 B2
(45) Date of Patent: Aug. 22, 2023

(54) GREASE COMPOSITION

(71) Applicant: GKN Driveline International GmbH, Lohmar (DE)

(72) Inventors: Jisheng E, Hennef (DE); Christoph Lindlahr, Bonn Deutschland (DE)

(73) Assignee: GKN Driveline International GmbH, Lohmar (DE)

( * ) Notice: Subject to any disclaimer, the term of this patent is extended or adjusted under 35 U.S.C. 154(b) by 0 days.

(21) Appl. No.: 17/765,509

(22) PCT Filed: Oct. 30, 2019

(86) PCT No.: PCT/EP2019/079682
§ 371 (c)(1),
(2) Date: Mar. 31, 2022

(87) PCT Pub. No.: WO2021/083511
PCT Pub. Date: May 6, 2021

(65) Prior Publication Data

US 2022/0364012 A1 Nov. 17, 2022

(51) Int. Cl.
*C10M 169/00* (2006.01)
*C10M 105/04* (2006.01)
(Continued)

(52) U.S. Cl.
CPC ..... *C10M 169/00* (2013.01); *C10M 105/04* (2013.01); *C10M 105/06* (2013.01);
(Continued)

(58) Field of Classification Search
CPC . C10M 111/04; C10M 169/00; C10M 117/02; C10M 135/18; C10M 105/06;
(Continued)

(56) References Cited

U.S. PATENT DOCUMENTS 2,790,776 A * 4/1957 Peterson ..... C10M 5/00 507/140
3,127,346 A 3/1964 Oliver et al.
(Continued)

FOREIGN PATENT DOCUMENTS

CN 1321733 A 11/2001
CN 109777554 A 5/2019
(Continued)

OTHER PUBLICATIONS

International Search Report and Written Opinion for PCT/EP2019/079682 dated Jun. 24, 2020 (9 pages).

*Primary Examiner* — Vishal V Vasisth
(74) *Attorney, Agent, or Firm* — Bejin Bieneman PLC

(57) ABSTRACT

A grease composition is disclosed which is intended primarily for use in constant velocity joints (CV joints), especially ball joints and/or tripod joints, which are used in the driveline of motor vehicles. The grease composition for use in constant velocity joints comprises at least one base oil, at least one thickener, zinc sulfide, at least one copper sulfide and molybdenum disulfide and/or tungsten disulfide. Further, the present disclosure relates to a constant velocity joint comprising such a grease composition.

17 Claims, 2 Drawing Sheets

(51) Int. Cl.

| | |
|---|---|
| ***C10M 105/06*** | (2006.01) |
| ***C10M 107/02*** | (2006.01) |
| ***C10M 111/04*** | (2006.01) |
| ***C10M 115/08*** | (2006.01) |
| ***C10M 117/02*** | (2006.01) |
| ***C10M 125/22*** | (2006.01) |
| ***C10M 135/18*** | (2006.01) |
| ***C10M 137/04*** | (2006.01) |
| ***C10M 141/10*** | (2006.01) |
| *C10N 40/04* | (2006.01) |
| *C10N 50/10* | (2006.01) |

(52) U.S. Cl.
CPC ..... *C10M 107/02* (2013.01); *C10M 111/04* (2013.01); *C10M 115/08* (2013.01); *C10M 117/02* (2013.01); *C10M 125/22* (2013.01); *C10M 135/18* (2013.01); *C10M 137/04* (2013.01); *C10M 141/10* (2013.01); *C10M 2201/066* (2013.01); *C10M 2203/1025* (2013.01); *C10M 2203/1065* (2013.01); *C10M 2205/0206* (2013.01); *C10M 2207/1265* (2013.01); *C10M 2215/28* (2013.01); *C10M 2219/068* (2013.01); *C10M 2223/04* (2013.01); *C10N 2040/04* (2013.01); *C10N 2050/10* (2013.01)

(58) Field of Classification Search
CPC ..... C10M 141/08; C10M 107/02; C10M 159/00; C10M 163/00; C10M 125/22; C10M 2203/1006; C10M 2219/068; C10M 2207/1265; C10M 2215/064; C10M 2205/0285; C10M 2207/1285; C10M 2201/066; C10M 2203/065; C10M 2203/1065; C10M 2219/022; C10M 2201/065; C10M 2205/0206; C10M 2207/2805; C10M 2215/1026; C10N 2030/10; C10N 2050/10; C10N 2020/06; C10N 2040/046; C10N 2030/36; C10N 2030/06; C10N 2010/12; C10N 2010/02
See application file for complete search history.

(56) References Cited

U.S. PATENT DOCUMENTS

| | | | |
|---|---|---|---|
| 5,607,906 | A | 3/1997 | Okaniwa et al. |
| 5,670,461 | A | 9/1997 | Schreiber et al. |
| 6,656,890 | B1 | 12/2003 | Fish et al. |
| 2009/0247435 | A1 | 10/2009 | E et al. |

FOREIGN PATENT DOCUMENTS

| | | | | |
|---|---|---|---|---|
| EP | 1967572 | A1 | 9/2008 | |
| GB | 742547 | A | 12/1955 | |
| GB | 1543592 | A | 4/1979 | |
| JP | S51-126473 | A | 11/1976 | |
| JP | H02180993 | A | 7/1990 | |
| JP | H0696949 | A | 4/1994 | |
| JP | H08-165488 | A | 6/1996 | |
| JP | H10-121086 | A | 5/1998 | |
| JP | 2004123858 | A | 4/2004 | |
| JP | 2004524415 | A | 8/2004 | |
| JP | 2008163201 | A | 7/2008 | |
| JP | 2011512432 | A | 4/2011 | |
| JP | 2013-504649 | A | 2/2013 | |
| JP | 2022-548661 | A | 11/2022 | |
| JP | 2022-548662 | A | 11/2022 | |
| RU | 2061739 | C1 | 6/1996 | |
| WO | 9502657 | A1 | 1/1995 | |
| WO | WO-2009121378 | A1 * | 10/2009 | ..... C10M 169/00 |

* cited by examiner

GREASE COMPOSITION

CROSS-REFERENCE TO RELATED APPLICATIONS

This application is a national stage of, and claims priority to, Patent Cooperation Treaty Application No. PCT/EP2019/079682, filed on Oct. 30, 2019, which application is hereby incorporated herein by reference in its entirety.

TECHNICAL FIELD

The present disclosure relates to a grease composition which is intended primarily for use in constant velocity joints (CV joints), especially ball joints and/or tripod joints, which are used in the driveline of motor vehicles. Further, the present disclosure relates to a constant velocity joint comprising such grease composition.

BACKGROUND

Front-wheel drive cars have CV joints on both ends of the drive shafts (half shafts). Inner CV joints connect the drive shafts to the transmission. Outer CV joints connect the drive shafts to the wheels. Many rear-wheel drive and four-wheel drive cars as well as trucks have CV joints. CV joints or homokinetic joints allow the drive shaft to transmit power through a variable angle, at constant rotational speed, preferably without an appreciable increase in friction or play. In front-wheel drive cars, CV joints deliver the torque to the front wheels during turns.

There are two most commonly used types of CV joints: a ball-type and a tripod-type. In front-wheel drive cars, ball-type CV joints are used on the outer side of the drive shafts (outer CV joints), while the tripod-type CV joints mostly used on the inner side (inner CV joints). The motions of components within CV joints are complex with a combination of rolling and sliding. When the joints are under torque, the components are loaded together which can not only cause wear on the contact surfaces of the components, but also rolling contact fatigue and significant frictional forces between the surfaces.

CV joints also have sealing boots of elastomeric material which are usually of bellows shape, one end being connected to the outer part of the CV joint and the other end to the interconnecting or output shaft of the CV joint. The sealing boot retains the grease in the joint and keeps out dirt and water.

Not only must the grease reduce wear and friction and prevent the premature initiation of rolling contact fatigue in a CV joint, it must also be compatible with the elastomeric material of which the sealing boot is made. Otherwise there is a degradation of the sealing boot material which causes premature failure of the sealing boot, allowing the escape of the grease and ultimately failure of the CV joint. It is one of the most common problems with the CV joints when the protective sealing boot cracks or gets damaged. Once this happens, in addition to the escape of the grease, moisture and dirt get in, causing the CV joint to wear faster and eventually fail due to lack of lubrication and corrosion. Usually, outer CV joint sealing boots break first, as they have to endure more movement than the inner ones. If a CV joint itself is worn out, it cannot be repaired, it will have to be replaced with a new or reconditioned part. The two main types of material used for CV joint sealing boots are polychloroprene rubber (CR) and thermoplastic elastomer (TPE), especially ether-ester block co-polymer thermoplastic elastomer (TPC-ET).

Typical CV joint greases have base oils which are blends of naphthenic (saturated rings) and paraffinic (straight and branched saturated chains) mineral oils. Synthetic oils may also be added. It is known that said base oils have a large influence on the deterioration (swelling or shrinking) of both sealing boots made of CR and TPC-ET. Both mineral and synthetic base oils extract the plasticisers and other oil soluble protective agents from the sealing boot materials. Paraffinic mineral oils and poly-α-olefin (PAO) synthetic base oils diffuse very little into especially sealing boots, but on the other hand naphthenic mineral oils and synthetic esters diffuse into sealing boot materials like rubber and TPC-ET and act as plasticisers and can cause swelling. The exchange of plasticiser or plasticiser compositions for the naphthenic mineral oil can significantly reduce the sealing boot performance, especially at low temperatures, and may cause the sealing boot to fail by cold cracking, ultimately resulting in failure of the CV joint. If significant swelling or softening occurs, the maximum high-speed capability of the sealing boot is reduced due to the poor stability at speed and/or excessive radial expansion.

In order to solve the aforesaid problems, U.S. Pat. No. 5,670,461 A suggests a lubricating grease for high temperature use consisting essentially of 60 to 90% by weight (wt-%) of a base oil mixture comprising at least one mineral oil and at least one synthetic oil, 5 to 16% by weight of at least one urea compound as a thickener, wherein the at least one urea compound is a reaction product of at least one fatty amine and at least one isocyanate or at least one diisocyanate, 2 to 20% weight of calcium complex grease, 1 to 4% by weight of molybdenum disulfide, 0.2 to 1% by weight of graphite powder, 0.2 to 1% by weight of polytetrafluoroethylene powder, 0.2 to 1% weight of solid particles of at least one organic molybdenum compound selected from a molybdenum dithiocarbamate (MoDTC) and a molybdenum dithiophosphate, up to 2% by weight of a metal deactivator and up to 2% by weight of a corrosion inhibitor, in each case the amounts referring to the total amount of the grease composition. However, the sealing boot compatibility of the grease compositions according to U.S. Pat. No. 5,670,461 A as measured in a boot compatibility tests as well as the lifetime of the entire CV joint needs to be improved. This holds in particular for the lifetime of the CV joint measured in a Standard Multi Block Program (SMBP) test. There is a need of further enhancement due to the fact that the additives disclosed in said grease composition may react with the sealing boot material that leads to early aging which also may result in a premature failure of the sealing boot. Especially, polytetrafluoroethylene (PTFE) has to be recycled due to high environmental stability as well as reproductive toxicity and the export is subject to authorization nowadays. Further on, it is known that PTFE decomposes under mechanical stress and high temperatures. In particular, alkali metals could react with PTFE which indicates that reactive degradation products would be available in the lubricant grease. Alkali metals are used in thickeners or grease formulations, e.g., in U.S. Pat. No. 5,670,461 A calcium complex grease is used. Not only degradation products formed in use of the CV joint may attack the sealing material leading to early failure, but also PTFE vapor being toxic may result. Based on these facts, it is recommended to improve the grease compatibility and elongate the lifetime of the sealing boot material.

Like U.S. Pat. No. 5,670,461 A, most of the commercial CV joint lubricants contain molybdenum dithiophosphate (MoDTP) or molybdenum dithiocarbamate (MoDTC), which provides anti-friction, anti-wear and EP performance, in particular improved anti-friction properties at early running-times (run-in) of the CV joints. Further on, the often-used molybdenum dialkyldithiophosphate (MoDTP) as well as zinc dialkyldithiophosphate (ZnDTP) and copper dialkyldithiophosphate (CuDTP) provide anti-wear performance based on a tribochemical reaction on the metal surfaces of CV joints. Thereby, a layer on the metal surface is formed, whereby the formed layer repairs the metal surface if Cu-containing additive is involved.

The disadvantage especially of using dithiophosphate (DTP) containing additives like ZnDTP, CuDTP and MoDTP is that they show no good compatibility with sealing materials, especially sealing boots. The dithiophosphate of ZnDTP, CuDTP and MoDTP reacts at high temperatures with the sealing boot material and causes decomposition of the sealing boot material. Additionally, the sulphur and phosphorus contained in ZnDTP is chemically activated which leads to further ageing of the sealing boot material. In large quantities, the grease might therefore result in an early failure of the sealing boots used in CV joints.

Thus, it would be advantageous to reduce the negative chemical effects of at least the aforesaid components of grease compositions on the sealing boot material, while maintaining the overall lubricating properties, in order to achieve a longer lifetime of the entire CV joint.

Disclosed herein is a grease composition, primarily for use in CV joints, which has a good compatibility with sealing boots made of rubber (CR) or thermoplastic elastomer (TPC-ET), and which also gives an enhanced life endurance in the entire CV joint.

SUMMARY

A grease composition for use in constant velocity joints, preferably with boots made of at least one TPE, further preferably made of at least one TPC-EP, comprises:

a) at least one base oil;
b) at least one thickener;
c) zinc sulfide in an amount between approximately 0.05 wt-% and approximately 2.0 wt-%, the wt-% referring to the total amount of the grease composition;
d) at least one copper sulfide in an amount between approximately 0.01 wt-% and approximately 1.5 wt-%, the wt-% referring to the total amount of the grease composition; and
e) molybdenum disulfide and/or tungsten disulfide in an amount between approximately 0.5 wt-% and approximately 5.0 wt-%, the wt-% referring to the total amount of the grease composition.

The advantage of the present composition for use in CV joints is that a combined formulation of zinc sulfide, at least one copper sulfide and molybdenum disulfide and/or tungsten disulfide show a synergistic effect. Zinc sulfide incorporates two main characteristics which are good EP performance given by the sulphur and anti-wear performance provided by the zinc. Also, copper sulfide incorporates two main characteristics which are good EP performance, given by the sulphur, as well as potential surface repairing function while an improved tribology is provided by the copper. Thereby, the included copper of the copper sulfide not only reduces wear as well as the friction coefficient, it is also considered to repair worn surfaces under high pressure which could lead to a prolonged lifetime of the metal compounds, i.e. the entire CV joint. Further on, it is proven that molybdenum disulfide as well as tungsten disulfide reduce friction, provide anti-wear and enhance EP performance in grease composition. The inventors have found that a grease composition featuring a combination of zinc sulfide, at least one copper sulfide and molybdenum disulfide and/or tungsten disulfide effectively replaces the additives ZnDTP, CuDTP or MoDTP. The mentioned synergistic effect is a higher lubrication performance at lower amounts of used additives which are also more compatible with the sealing boot material leading to lower wear and friction coefficient while elongating the lifetime of the CV joint. This may be proven for example by the Standard Multi Block Program (SMBP) test. In particular, the endurance under heavy application of the CV joint, as well as the compatibility with CV joint sealing boot material are improved by the grease composition in accordance with the present disclosure.

Metal sulfides are featuring more stable bonds than in the case of organic metal salts, like ZnDTP, CuDTP or MoDTP, during mechanical shearing and heat. It is well known that organic metal salts decompose under heavy application into the inorganic salt and an organic radical. In contrast thereto, zinc sulfide and copper sulfide with molybdenum sulfide and/or tungsten disulfide are stable compounds without critical chemical activity inside the molecule under heavy application. Advantageously, the reaction of all sulfides with sealing boot material is minimized while the lubricating properties are maintained.

Further on, the amount of sulphur in the metal sulfides is higher than in organic metal complexes as ZnDTP, CuDTP or MoDTP. For example, zinc sulfide provides zinc in an amount of about 1700 ppm already in 0.25 wt-% zinc sulfide, (% by weight or weight percent, in connection with the present disclosure the term wt-% is used in the following,) whereas the same amount of zinc is present in 2 wt-% of ZnDTP, in each case the wt-% referring to the total amount of a grease composition. Due to the fact that zinc sulfide is an inorganic salt, no organic decomposition product results under heat or heavy application as known from ZnDTP, CuDTP and MoDTP. Therefore, the reaction of zinc sulfide with sealing boot material is minimized while the tribochemical properties are maintained.

It is also advantageous that the grease composition requires less material in terms of additives. Due to the fact that zinc sulfide as well as copper sulfide enhances the tribochemical properties of molybdenum disulfide and/or tungsten disulfide as in a synergistically way, the needed amounts of these additives are further reduced. The mentioned reduction of additive quantities also leads to a cost decrease in the production of the grease composition.

The inventors have found that molybdenum disulfide and/or tungsten disulfide in suitable amounts enables the zinc sulfide and copper sulfide to provide advantageous anti-wear and, in particular, improved anti-friction properties. In this respect, the inventors have found that zinc sulfide and copper sulfide in combination with molybdenum disulfide and/or tungsten disulfide increases the tribology performance in combination with organic sulphur-containing additive and organic phosphorus-containing additive for the early running times (run-in) of the CV joints. Consequently, not only the known synergistic effect of the organic sulphur-containing additive with organic phosphorus-containing additive improves the tribology performance, but also zinc sulfide and copper sulfide in combination with molybdenum disulfide and/or tungsten disulfide act together synergistically. This synergistic effect is well shown by the life endurance of the constant velocity joints measured by a SMBP test.

As far as the term weight percent or % by weight is used with respect to the components being comprised from the claimed grease composition, the term weight percent is referred to the amount of one or more components relative to the total amount of the grease composition throughout this specification, except where expressively stated otherwise. The expression "wt-%" is used throughout the present disclosure as an abbreviation for weight percent if not indicated otherwise.

In the context of this disclosure, the expressions "about" and "approximately" in connection with numerical values or ranges are to be understood as a tolerance range, which a person skilled in the art would consider as common or reasonable based on his or her general knowledge and in view of the disclosure as a whole. In particular, the expressions "about" and "approximately" refer to a tolerance range of ±20%, preferably ±10% and further preferably ±5% with respect to the designated value. The lower end values and the upper end values of the various ranges, especially the weight percent ranges, but not restricted thereto, claimed in the present disclosure may be combined with each other in order to define new ranges.

Further, in the context of the present disclosure, all references to standards, norms, or standardization protocols, e.g., ISO, ASTM, etc., in connection with properties, numerical values or ranges referred to are to be understood as the latest updated version of said standard, norm, or standardization protocol being in force at the date of filing of this disclosure.

DETAILED DESCRIPTION

Figure 1A:
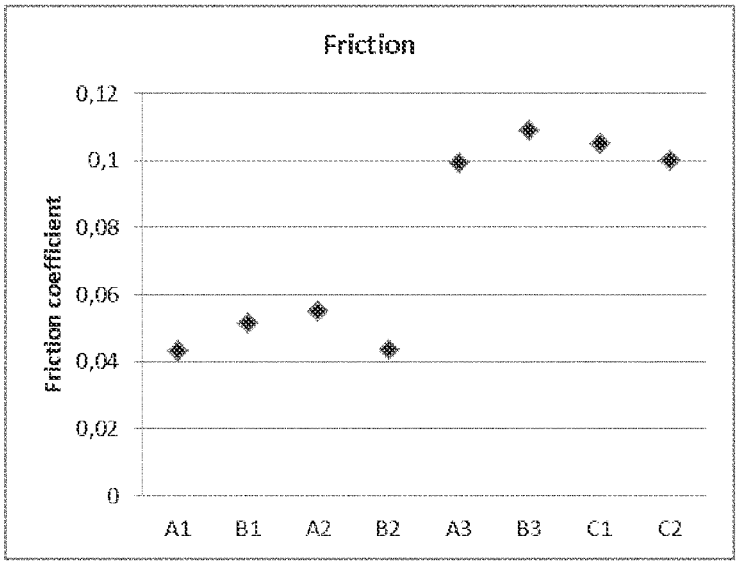
FIGS. 1*a* and 1*b* are plots of experimental results for friction and wear, respectively, for the additive effect of zinc sulfide in combination with copper sulfide in a plurality of grease compositions.

A grease composition, primarily for use in constant velocity joints, preferably with boots made of at least one TPE, further preferably made of at least one TPC-EP, includes at least one base oil, at least one thickener, zinc sulfide, at least one copper sulfide, and molybdenum disulfide and/or tungsten sulfide.

Preferably, the at least one base oil used in the grease composition in accordance with the present disclosure comprises poly-α-olefines, metal poly-α-olefines, naphthenic oils, paraffinic oils, polyether polyols and/or synthetic organic esters. As at least one base oil according to the present disclosure, a base oil as disclosed in U.S. Pat. No. 6,656,890 B1 may preferably be used, the disclosure of which is incorporated insofar herein by reference. However, any further kind of base oil, especially a blend of mineral oils, a blend of synthetic oils or a blend of a mixture of mineral and synthetic oils may be used. The at least one base oil should preferably have a kinematic viscosity of between approximately 32 and approximately 250 $mm^2/s$ at 40° C. and between approximately 5 and approximately 25 $mm^2/s$ at 100° C. The mineral oils are preferably selected from the group comprising at least one naphthenic oil and/or at least one paraffinic oil. The synthetic oils usable in the present disclosure are selected from a group comprising at least one poly-α-olefine and/or at least one organic ester. The organic synthetic ester is preferably a di-carboxylic acid derivative having subgroups based on aliphatic alcohols. Preferably, the aliphatic alcohols have primary, straight or branched carbon chains with 2 to 20 carbon atoms. Preferably, the organic synthetic ester is selected from a group comprising sebacic acid-bis(2-ethylhexylester) ("dioctyl sebacate" (DOS)), adipic acid-bis-(2-ethylhexylester) ("dioctyl adipate" (DOA)), dioctyl phthalate (DOP) and/or azelaic acid-bis(2-ethylhexylester) ("dioctyl azelate (DOZ)). If poly-α-olefin is present in the base oil, the poly-α-olefin is preferably selected from a group comprised of 1-dodecene oligomer, 1-decene oligomer, 1-octene or a mixture thereof, and even more preferably a copolymer comprising 1-octene, poly-1-decene oligomer, poly-1-dodecene oligomer or a mixture thereof, wherein the poly-1-decene oligomer and the poly-1-dodecene oligomer could be dimeric, trimeric, tetrameric, pentameric or higher. Preferably, poly-α-olefins are selected having a kinematic viscosity (measured in accordance with ASTM D445) in a range from approximately 2 to approximately 60 centistokes at 40° C. The naphthenic oils selected for the at least one base oil have preferably a kinematic viscosity in a range between approximately 3 to approximately 370 $mm^2/s$, more preferably approximately 20 to approximately 150 $mm^2/s$ at 40° C. The density (measured in accordance with ASTM D1250) is approximately 0.9 up to approximately 1.0 $g/cm^3$ at 15.6° C. The paraffinic oils present in the at least one base oil are preferably selected from a group comprising linear, branched and cyclic saturated alkanes of polyolefins, hydroisomerized Fischer-Tropsch wax, and Fischer-Tropsch oligomerized olefins, preferably isoparaffins, cycloparaffins containing mono-ring and/or multi-ring structures. Preferably the paraffinic oils have a kinematic viscosity in a range between approximately 9 to approximately 170 $mm^2/s$ at 40° C., preferably approximately 50 to approximately 130 $mm^2/s$ at 40° C. The at least one base oil is preferably present in the grease composition in accordance with the present disclosure in an amount of approximately 60 wt-% up to approximately 95 wt-% and further preferred in an amount of approximately 63 wt-% up to approximately 93 wt-%, further preferred in an amount of approximately 75 wt-% up to approximately 92.5 wt-%, further preferred in an amount of approximately 78 wt-% up to approximately 92 wt-%, and even further preferred in an amount of approximately 79 wt-% up to approximately 92 wt-%, in each case referred to the total amount of the grease composition in accordance with the present disclosure. Preferably, the at least one base oil may comprise at least one paraffinic oil in an amount of approximately 30 wt-% up to approximately 85 wt-%, further preferred of approximately 35 wt-% up to approximately 75 wt-%, and even further preferred in an amount of approximately 37 wt-% up to approximately 72 wt-%, in each case referred to the total amount of the base oil. Preferably, the at least one base oil may comprise at least one naphthenic oil in an amount of approximately 15 wt-% up to approximately 80 wt-%, further preferred in an amount of approximately 15 wt-% up to approximately 75 wt-%, and even further preferred in an amount approximately 15 wt-% up to approximately 70 wt-%, in each case referred to the total amount of the base oil. The term base oil as used in the present disclosure is understood in the sense that the base oil may also be a base oil composition that consists of various components, and, especially, that the base oil is a composition comprising poly-α-olefines, naphthenic oils, paraffinic oils, and/or synthetic organic esters. Preferably, the at least one base oil comprises the at least one paraffinic oil in an amount of approximately 30 wt-% up to approximately 85 wt-%, further preferred of approximately 35 wt-% up to approximately 75 wt-%, and even further preferred approximately 37 wt-% up to approximately 72 wt-%, and at least one naphthenic oil in an amount of approximately 15 wt-% up to approximately 70 wt-%, further preferred approximately 15 wt-% up to approximately 65 wt-%, and even further preferred approximately 15 wt-% up to approximately 62 wt-%, in each case referred to the total amount of the base oil.

Preferably, the at least one thickener is preferably a lithium soap thickener or a urea thickener, of which the use of a lithium soap thickener is most preferred. A lithium soap thickener is a reaction product of at least one fatty acid with lithium hydroxide. Preferably, the thickener may be a simple lithium soap formed from stearic acid, 12-hydroxy stearic acid, hydrogenated castor oil or from other similar fatty acids or mixtures thereof or methylesters of such acids. Alternatively, a lithium complex soap may be used formed for example from a mixture of long-chained fatty acids together with a complexing agent, for example a borate of one or more dicarboxylic acids. The use of complex lithium soaps allows the grease composition according to the present disclosure to operate up to a temperature of about 180° C., whereas with simple lithium soaps, the grease composition will only operate up to a temperature of about 120° C. The urea thickener may be chosen among diurea compounds as well as polyurea compounds. For example, diurea compounds are selected from a group obtained through a reaction of monoamine with a diisocyanate compound such as phenylene diisocyanate, diphenyl diisocyanate, phenyl diisocyanate, diphenylmethane diisocyanate, octadecane diisocyanate, decane diisocyanate and hexane diisocyanate, examples of such monoamines are octylamine, dodecylamine, hexadecylamine, octadecylamine, oleylamine, aniline, p-toluidine, and cyclohexylamine; polyurea compounds are selected from a group obtained through a reaction of diamine with a diisocyante compound such as diisocyanates as mentioned above and diamines include ethylenediamine, propanediamine, butanediamin, hexanediamine, octanediamine, phenylenediamine, tolylenediamine, and xylenediamine; or urea thickeners are selected from a group obtained through a reaction of aryl amine such as p-toluidine or aniline, cyclohexyl amine or a mixture thereof with diisocyante. The aryl group of the diurea compound, if present, is preferably comprised of 6 or 7 carbon atoms. However, mixtures of all of the aforesaid thickeners such as lithium soap thickeners and urea thickeners may also be used. The at least one thickener is preferably present in an amount of approximately 2 wt-% up to approximately 20 wt-%, further preferred in an amount of approximately 4.0 wt-% up to approximately 17.0 wt-%, in each case referred to the total amount of the grease composition in accordance with the present disclosure.

Zinc sulfide is present in a solid state. Zinc sulfide naturally occurs as cubic sphalerite or hexagonal wurtzite. Preferably industrial produced zinc sulfide powder is used, however, the crystalline structure is not further distinguished. The preferred zinc sulfide is a colorless and odourless powder with a main grain size $D_{90}$ of 0.80 μm by a CLIAS 1064 Nass regarding ISO 13320. Further on, the density at 20° C. is up to 4.0 g/cm$^3$, and the melting point is greater than 800° C. (sublimating). The decomposition temperature is greater than 600° C. According to this disclosure, zinc sulfide is present in an amount of approximately 0.05 wt-% up to approximately 2.0 wt-%, further preferred in an amount of approximately 0.1 wt-% up to approximately 1.0 wt-%, in each case referred to the total amount of the grease composition in accordance with the present disclosure.

Preferably, the at least one copper sulfide is copper(II) sulfide. The grease composition may also comprise copper (I) sulfide (copper disulfide, $Cu_2S$). The at least one copper sulfide is present in a solid state. In nature, copper monosulfide occurs as the mineral Covellin. Copper disulfide occurs naturally as monoclinic crystallizing mineral Chalcosine, also known as copper luster, and the tetragonal crystallizing mineral Wuyanzhiite. Preferably, industrial produced copper sulfide powder is used, however, the crystalline structure is not further distinguished. In the grease composition, copper sulfide powder is preferably used over crystals, dispersions or even as solutions in water or ethanol. In the grease composition, copper(II) sulfide is preferably used as powder with a particle size $D_{90}$ of 15 μm measured by a CLIAS 1064 Nass regarding ISO 13320. Further on, the density at 20° C. is up to 4.6 g/cm$^3$. The used copper(I) sulfide preferably is powdered with a particle size $D_{90}$ of 53.6 μm measured by a CLIAS 1064 Nass regarding ISO 13320. Further on, the density at 20° C. is up to 5.5 g/cm$^3$. According to this disclosure, the at least one copper sulfide is present in an amount of approximately 0.01 wt-% up to approximately 1.5 wt-%, further preferred in an amount of approximately 0.1 wt-% up to approximately 1.0 wt-%, in each case the wt-% referring to the total amount of the grease composition in accordance with the present disclosure.

The grease composition of the present disclosure comprises molybdenum disulfide and/or tungsten disulfide. Molybdenum disulfide (molybdenum(IV) sulfide, $MoS_2$) is preferably used over molybdenum(VI) sulfide ($MoS_3$) and/or molybdenum (V) sulfide ($Mo_2S_5$). In the grease composition, molybdenum disulfide super fine powder is preferably used over crystals, dispersions or even as solutions in water or ethanol. The preferred used super fine molybdenum disulfide powder has a purity of 97 wt-%, a Fisher number of 0.40 up to 0.50 μm, further a particle size distribution $D_{90}$ of 7.0 μm by laser diffraction instrument, Microtrac X100$^2$ with the standardization of ISO 13320, and a bulk density of 0.4 g/cm$^3$. To protect molybdenum disulfide before oxidation, preferably an anti-oxidation agent might be used. Tungsten disulfide (tungsten(IV) sulfide, $WS_2$) is present in a solid state like molybdenum disulfide ($MoS_2$), more preferably as dark grey powder than as crystal, dispersion or even as solution in water or ethanol. The dark grey tungsten disulfide powder has preferably an average particle size $D_{90}$ of 4 μm and a density of 7.5 g/cm$^3$. Tungsten disulfide is a thermostable compound. Molybdenum disulfide and/or tungsten disulfide provides for a reduction of friction and anti-wear performance as well as EP performance.

In the grease compositions in accordance with the present disclosure, the combination of zinc sulfide and copper sulfide with molybdenum disulfide and/or tungsten disulfide shows a synergistic effect in the SRV test for the anti-wear and anti-friction properties of CV joints. According to this disclosure, the molybdenum disulfide and/or tungsten disulfide is present in an amount of approximately 0.5 wt-% up to approximately 5.0 wt-%, further preferred in an amount of approximately 1.0 wt-% up to approximately 3.0 wt-%, in each case referred to the total amount of the grease composition in accordance with the present disclosure. Preferably, the total amount of zinc sulfide, copper sulfide and molybdenum disulfide and/or tungsten disulfide is between approximately 0.5 wt-% up to approximately 7 wt-%, and further preferred approximately 1.0 wt-% up to approximately 4 wt-%, in each case referred to the total amount of the grease composition in accordance with the present disclosure.

It is also possible to include in the grease composition of the present disclosure various known grease additives such as anti-oxidation agents, antirust agents, extreme-pressure (EP) modifier agents, anti-wear agents and oil-improvers. Preferably comprised in the grease composition are the following grease additives.

In an example, at least one grease additive containing a sulphur-containing EP modifier agent and/or a phosphorous-containing EP modifier agent is present that enhances the tribochemical effect of zinc sulfide and copper sulfide with molybdenum disulfide and/or tungsten disulfide by a preferred simultaneous reduction of the needed amounts of molybdenum disulfide and/or tungsten disulfide. In the context of the present disclosure, the expression sulphur-containing EP modifier agent is referred to as organic sulphur-additive and the expression phosphorus-containing EP modifier agent is referred to as organic phosphorus-additive in the following description.

In an example, at least one organic sulphur-additive is comprised in the grease composition. ZnDTP, CuDTP and MoDTP are not considered in the sense of the present disclosure to be encompassed by the term of organic sulphur-additives. In another example, the at least one organic sulphur-additive is selected from a group comprising at least one olefin sulfide, alkyl thiadiazole or a combination of it. The olefin sulfide may comprise olefin monomers of ethylene, propylene, butane-1 and/or 4-methylpentene. The alkyl thiadiazole may comprise thiadiazole monomers of 1,2,3-thiadiazole, 1,2,4-thiadiazole, 1,2,5-thiadiazole and/or 1,3,4-thiadiazole. Preferably, the at least one organic sulphur-additive is comprised in an amount of approximately 0.2 wt-% up to approximately 1.0 wt-%, further preferred in an amount of approximately 0.5 wt-% up to approximately 0.7 wt-%, in each case referred to the total amount of the grease composition in accordance with the present disclosure. Preferably, the at least one organic sulphur-additive comprises sulphur in an amount of at least 10 wt-%, and even more preferred between approximately 20 wt-% up to approximately 70 wt-%, the wt-% referring to the total amount of the organic sulphur-additive.

In an example, at least one organic phosphorus-additive is present in the grease composition. The intended organic phosphorus-additive neither is a metallic salt nor contains sulphur like ZnDTP, CuDTP or MoDTP. The comprised phosphorus should be less activated than in the aforesaid additives to be avoided. Most important is that the at least one organic phosphorus-additive is compatible with the sealing boot material which means that the organic phosphorus-additive does not lead to degradation of the sealing boot, swelling or shrinking of the sealing boot material The at least one organic phosphorus-additive is preferably selected from a group comprising tri-substituted organic phosphates, such as iso-butyl phosphate (TiBP) which is a derivative of phosphoric acid ($H_3PO_4$), where all hydrogen atoms are substituted, for example in TiBP by iso-butyl. This special design provides an at least one organic phosphorus-additive which is relatively inactive in comparison to usual phosphorous additives with only one or two substituted hydrogen atoms of the phosphoric acid by an organic sidechain. Tri-iso-butyl phosphate (TiBP) as a preferred example of a trisubstituted organic phosphorus-additive provides for an enhanced EP performance and a temperature independent viscosity with a limited interaction with the sealing boot material which results in an elongated lifetime of the CV joint proven by the SMBP test. Preferably, the at least one organic phosphorus-additive is comprised in an amount of approximately 0.05 wt-% up to approximately 1.5 wt-%, further preferred in an amount of approximately 0.2 wt-% up to approximately 1.0 wt-%, in each case referred to the total amount of the grease composition in accordance with the present disclosure.

In an example, at least one anti-oxidation agent is present in the grease composition. As an at least one anti-oxidation agent, the grease composition may comprise an amine, preferably an aromatic amine, more preferably benzamine, N-phenyl compounds reacted with 2,4,4-trimethylpentene or selected from the group of octylated/butylated diphenylamine, more preferably dioctyl diphenylamine, octyl diphenylamine, octyl/styryl diphenylamine, diheptyl diphenylamine, dinonyl diphenylamine or a mixture thereof. Preferably, the at least one anti-oxidation agent is selected having a kinematic viscosity (in accordance with ASTM D445) in a range of approximately 250 to approximately 370 $mm^2/s$ at 40° C. and a density (in accordance with ASTM D1298) of approximately 0.9 to approximately 1.0 $g/cm^3$ at 20° C. The at least one anti-oxidation agent is used to prevent deterioration of the grease composition associated with oxidation. The grease composition may comprise at least one anti-oxidation agent in a range between approximately 0.1 wt-% to approximately 2 wt-%, referred to the total amount to the grease composition, in order to inhibit the oxidation degradation of the at least one base oil and/or molybdenum disulfide, as well as to lengthen the life of the grease composition, thus prolonging the life of the CV joint. Preferably, the at least one anti-oxidation agent is comprised in an amount of approximately 0.1 wt-% up to approximately 2.0 wt-%, further preferred in an amount of approximately 0.2 wt-% up to approximately 1.5 wt-%, in each case referred to the total amount of the grease composition in accordance with the present disclosure.

In an example, an at least one phosphorus-free molybdenum complex, preferably a molybdenum dithiocarbamate (MoDTC), is comprised in the grease composition. MoDTC is preferably of the following general formula (I):

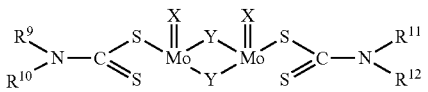

(I)

wherein X or Y represents S or O and each of R9 to R12 inclusive may be the same or different and each represents a primary (straight chain) or secondary (branched chain) alkyl group having between 3 and 20 carbon atoms. The at least one phosphorus-free molybdenum complex is present as solid MoDTC. The MoDTC is preferably present in an amount of approximately 0.1 wt-% up to approximately 3.0 wt-%, further preferred in an amount of approximately 0.5 wt-% up to approximately 2.0 wt-%, and even further preferred in an amount of approximately 0.8 wt-% up to approximately 2.0 wt-%, in each case the wt-% referring to the total amount of the grease composition in accordance with the present disclosure. In another example, the composition does not comprise any organic molybdenum-containing compound.

Further, the present disclosure refers to the use of a grease composition in accordance with the present disclosure in CV joints especially ball joints and/or tripod joints, and, further, to a CV joint comprising a grease composition as described. The CV joint especially encompasses a sealing boot, the sealing boot being filled with the grease composition in accordance with the present disclosure, at least in part, the sealing boot having a first attachment region which is assigned to a joint, and a second attachment region which is assigned to a shaft. The sealing boot may be fixed with usual clamp devices on the joint and/or shaft.

In an example, a grease composition is defined comprising approximately 60 wt-% to approximately 95 wt-% of at least one base oil, approximately 2 wt-% to approximately 20 wt-% of at least one thickener, approximately 0.05 wt-% to approximately 2.0 wt-% of zinc sulfide, approximately 0.01 wt-% to approximately 1.5 wt-% of at least one copper sulfide, approximately 0.5 wt-% to approximately 5.0 wt-% of molybdenum disulfide and/or tungsten disulfide, approximately 0.1 wt-% to approximately 1.5 wt-% of at least one organic sulphur-additive, and approximately 0.05 wt-% to approximately 1.5 wt-% of at least one organic phosphorus-additive, in each case the wt-% referring to the total amount of the grease composition.

In an example, a grease composition is defined comprising approximately 60 wt-% to approximately 95 wt-% of at least one base oil, approximately 2 wt-% to approximately 20 wt-% of at least one thickener, approximately 0.05 wt-% to approximately 2.0 wt-% of zinc sulfide, approximately 0.01 wt-% to approximately 1.5 wt-% of at least one copper sulfide, approximately 0.5 wt-% to approximately 5.0 wt-% of molybdenum disulfide and/or tungsten disulfide, approximately 0.1 wt-% to approximately 1.5 wt-% of at least one organic sulphur-additive, approximately 0.05 wt-% to approximately 1.5 wt-% of at least one organic phosphorus-additive and approximately 0.1 wt-% to approximately 2.0 wt-% of at least one anti-oxidation agent, in each case the wt-% referring to the total amount of the grease composition.

In an example, the grease composition comprises approximately 60 wt-% to approximately 95 wt-% of at least one base oil, approximately 2 wt-% to approximately 20 wt-% of at least one thickener, approximately 0.05 wt-% to approximately 2.0 wt-% of zinc sulfide, approximately 0.01 wt-% to approximately 1.5 wt-% of at least one copper sulfide, approximately 0.5 wt-% to approximately 5.0 wt-% of molybdenum disulfide and/or tungsten disulfide, approximately 0.1 wt-% to approximately 1.5 wt-% of at least one organic sulphur-additive, approximately 0.05 wt-% to approximately 1.5 wt-% of at least one organic phosphorus-additive and approximately 0.1 wt-% to approximately 2.0 wt-% of at least one anti-oxidation agent, in each case the wt-% referring to the total amount of the grease composition, whereat the at least one base oil comprises poly-α-olefins and/or metal poly-α-olefins and/or naphthenic oils and/or paraffinic oils and/or polyether polyols and/or synthetic organic esters.

In an example, the grease composition comprises approximately 60 wt-% to approximately 95 wt-% of at least one base oil, approximately 2 wt-% to approximately 20 wt-% of at least one thickener, approximately 0.05 wt-% to approximately 2.0 wt-% of zinc sulfide, approximately 0.01 wt-% to approximately 1.5 wt-% of at least one copper sulfide, approximately 0.5 wt-% to approximately 5.0 wt-% of molybdenum disulfide and/or tungsten disulfide, approximately 0.1 wt-% to approximately 1.5 wt-% of at least one organic sulphur-additive, approximately 0.05 wt-% to approximately 1.5 wt-% of at least one organic phosphorus-additive and approximately 0.1 wt-% to approximately 2.0 wt-% of at least one anti-oxidation agent, in each case the wt-% referring to the total amount of the grease composition, whereat the at least one base oil preferred comprises at least one paraffinic oil in an amount of approximately 30 wt-% up to approximately 85 wt-%, the latter amount referring to the total amount of the base oil, whereat the paraffinic oil is preferably selected from a group comprising linear, branched and cyclic saturated alkanes of polyolefins, hydroisomerized Fischer-Tropsch wax, and Fischer-Tropsch oligomerized olefins, preferably isoparaffins, cycloparaffins containing mono-ring and/or multi-ring structures.

In an example, the grease composition comprises approximately 60 wt-% to approximately 95 wt-% of at least one base oil, approximately 2 wt-% to approximately 20 wt-% of at least one thickener, approximately 0.05 wt-% to approximately 2.0 wt-% of zinc sulfide, approximately 0.01 wt-% to approximately 1.5 wt-% of at least one copper sulfide, approximately 0.5 wt-% to approximately 5.0 wt-% of molybdenum disulfide and/or tungsten disulfide, approximately 0.1 wt-% to approximately 1.5 wt-% of at least one organic sulphur-additive, approximately 0.05 wt-% to approximately 1.5 wt-% of at least one organic phosphorus-additive and approximately 0.1 wt-% to approximately 2.0 wt-% of at least one anti-oxidation agent, in each case the wt-% referring to the total amount of the grease composition, whereat the at least one base oil may comprise at least one naphthenic oil in an amount approximately 15 wt-% up to approximately 80 wt-%, the latter amount referring to the total amount of the base oil, whereat the naphthenic oil is preferably selected from a group comprising saturated cyclic alkanes.

In an example, the grease composition comprises approximately 60 wt-% to approximately 95 wt-% of at least one base oil, approximately 2 wt-% to approximately 20 wt-% of at least one thickener, approximately 0.05 wt-% to approximately 2.0 wt-% of zinc sulfide, approximately 0.01 wt-% to approximately 1.5 wt-% of at least one copper sulfide, approximately 0.5 wt-% to approximately 5.0 wt-% of molybdenum disulfide and/or tungsten disulfide, approximately 0.1 wt-% to approximately 1.5 wt-% of at least one organic sulphur-additive, approximately 0.05 wt-% to approximately 1.5 wt-% of at least one organic phosphorus-additive and approximately 0.1 wt-% to approximately 2.0 wt-% of at least one anti-oxidation agent, in each case the wt-% referring to the total amount of the grease composition, whereat the at least one thickener is selected from a group comprising lithium soap thickener and urea thickener, preferably the lithium soap thickener is a reaction product of at least one fatty acid with lithium hydroxide and the urea thickener is at least one compound of diurea and/or polyurea.

In an example, the grease composition comprises approximately 60 wt-% to approximately 95 wt-% of at least one base oil, approximately 2 wt-% to approximately 20 wt-% of at least one thickener, approximately 0.05 wt-% to approximately 2.0 wt-% of zinc sulfide, approximately 0.01 wt-% to approximately 1.5 wt-% of at least one copper sulfide, approximately 0.5 wt-% to approximately 5.0 wt-% of molybdenum disulfide and/or tungsten disulfide, approximately 0.1 wt-% to approximately 1.5 wt-% of at least one organic sulphur-additive, approximately 0.05 wt-% to approximately 1.5 wt-% of at least one organic phosphorus-additive and approximately 0.1 wt-% to approximately 2.0 wt-% of at least one anti-oxidation agent, in each case the wt-% referring to the total amount of the grease composition, whereat the zinc sulfide is comprised in a solid state.

In an example, the grease composition comprises approximately 60 wt-% to approximately 95 wt-% of at least one base oil, approximately 2 wt-% to approximately 20 wt-% of at least one thickener, approximately 0.05 wt-% to approximately 2.0 wt-% of zinc sulfide, approximately 0.01 wt-% to approximately 1.5 wt-% of at least one copper sulfide, approximately 0.5 wt-% to approximately 5.0 wt-% of molybdenum disulfide and/or tungsten disulfide, approximately 0.1 wt-% to approximately 1.5 wt-% of at least one organic sulphur-additive, approximately 0.05 wt-% to approximately 1.5 wt-% of at least one organic phosphorus-additive and approximately 0.1 wt-% to approximately 2.0 wt-% of at least one anti-oxidation agent, in each case the wt-% referring to the total amount of the grease composition, whereat the at least one copper sulfide is preferably comprised as copper(II) sulfide (CuS) in a solid state.

In an example, the grease composition comprises approximately 60 wt-% to approximately 95 wt-% of at least one base oil, approximately 2 wt-% to approximately 20 wt-% of at least one thickener, approximately 0.05 wt-% to approximately 2.0 wt-% of zinc sulfide, approximately 0.01 wt-% to approximately 1.5 wt-% of at least one copper sulfide, approximately 0.5 wt-% to approximately 5.0 wt-% of molybdenum disulfide and/or tungsten disulfide, approximately 0.1 wt-% to approximately 1.5 wt-% of at least one organic sulphur-additive, approximately 0.05 wt-% to approximately 1.5 wt-% of at least one organic phosphorus-additive and approximately 0.1 wt-% to approximately 2.0 wt-% of at least one anti-oxidation agent, in each case the wt-% referring to the total amount of the grease composition, whereat the molybdenum disulfide and/or tungsten disulfide is comprised in a solid state.

In an example, the grease composition comprises approximately 60 wt-% to approximately 95 wt-% of at least one base oil, approximately 2 wt-% to approximately 20 wt-% of at least one thickener, approximately 0.05 wt-% to approximately 2.0 wt-% of zinc sulfide, approximately 0.01 wt-% to approximately 1.5 wt-% of at least one copper sulfide, approximately 0.5 wt-% to approximately 5.0 wt-% of molybdenum disulfide and/or tungsten disulfide, approximately 0.1 wt-% to approximately 1.5 wt-% of at least one organic sulphur-additive, approximately 0.05 wt-% to approximately 1.5 wt-% of at least one organic phosphorus-additive and approximately 0.1 wt-% to approximately 2.0 wt-% of at least one anti-oxidation agent, in each case the wt-% referring to the total amount of the grease composition, whereat the total amount of zinc sulfide and copper sulfide with molybdenum disulfide and/or tungsten disulfide is between approximately 0.5 wt-% up to approximately 7 wt-%, and further preferred approximately 1.0 wt-% up to approximately 4 wt-%, in each case the wt-% referring to the total amount of the grease composition.

In an example, the grease composition comprises approximately 60 wt-% to approximately 95 wt-% of at least one base oil, approximately 2 wt-% to approximately 20 wt-% of at least one thickener, approximately 0.05 wt-% to approximately 2.0 wt-% of zinc sulfide, approximately 0.01 wt-% to approximately 1.5 wt-% of at least one copper sulfide, approximately 0.5 wt-% to approximately 5.0 wt-% of molybdenum disulfide and/or tungsten disulfide, approximately 0.1 wt-% to approximately 1.5 wt-% of at least one organic sulphur-additive, approximately 0.05 wt-% to approximately 1.5 wt-% of at least one organic phosphorus-additive and approximately 0.1 wt-% to approximately 2.0 wt-% of at least one anti-oxidation agent, in each case the wt-% referring to the total amount of the grease composition, whereat the at least one organic sulphur-additive comprises sulphur in an amount of at least 10 wt-%, and even more preferred between approximately 20 wt-% up to approximately 70 wt-%, the wt-% referring to the total amount of the organic sulphur-additive, and whereat the at least one organic sulphur-additive is preferably selected from a group comprising at least one alkyl thiadiazole or olefin sulfide made up of reaction products with olefin monomers as ethylene, propylene, butane-1 and/or 4-methylpentene.

In an example, the grease composition comprises approximately 60 wt-% to approximately 95 wt-% of at least one base oil, approximately 2 wt-% to approximately 20 wt-% of at least one thickener, approximately 0.05 wt-% to approximately 2.0 wt-% of zinc sulfide, approximately 0.01 wt-% to approximately 1.5 wt-% of at least one copper sulfide, approximately 0.5 wt-% to approximately 5.0 wt-% of molybdenum disulfide and/or tungsten disulfide, approximately 0.1 wt-% to approximately 1.5 wt-% of at least one organic sulphur-additive, approximately 0.05 wt-% to approximately 1.5 wt-% of at least one organic phosphorus-additive and approximately 0.1 wt-% to approximately 2.0 wt-% of at least one anti-oxidation agent, in each case the wt-% referring to the total amount of the grease composition, whereat the at least one organic phosphorus-additive is preferably selected from a group comprising tri-substituted organic phosphates, further preferred iso-butyl phosphate (TiBP).

In an example, the grease composition comprises approximately 60 wt-% to approximately 95 wt-% of at least one base oil, approximately 2 wt-% to approximately 20 wt-% of at least one thickener, approximately 0.05 wt-% to approximately 2.0 wt-% of zinc sulfide, approximately 0.01 wt-% to approximately 1.5 wt-% of at least one copper sulfide, approximately 0.5 wt-% to approximately 5.0 wt-% of molybdenum disulfide and/or tungsten disulfide, approximately 0.1 wt-% to approximately 1.5 wt-% of at least one organic sulphur-additive, approximately 0.05 wt-% to approximately 1.5 wt-% of at least one organic phosphorus-additive and approximately 0.1 wt-% to approximately 2.0 wt-% of at least one anti-oxidation agent, in each case the wt-% referring to the total amount of the grease composition, whereat the at least one anti-oxidation agent is preferably an amine, more preferably aromatic amines, even more preferably benzamine and/or N-phenyl compounds reacted with 2,4,4-trimethylpentene or selected from the group of octylated/butylated diphenylamine, more preferably dioctyl diphenylamine, octyl diphenylamine, octyl/styrryl diphenylamine, diheptyl diphenylamine, dinonyl diphenylamine or a mixture thereof.

In an example, the grease composition comprises approximately 60 wt-% to approximately 95 wt-% of at least one base oil, approximately 2 wt-% to approximately 20 wt-% of at least one thickener, approximately 0.05 wt-% to approximately 2.0 wt-% of zinc sulfide, approximately 0.01 wt-% to approximately 1.5 wt-% of at least one copper sulfide, approximately 0.5 wt-% to approximately 5.0 wt-% of molybdenum disulfide and/or tungsten disulfide, approximately 0.1 wt-% to approximately 1.5 wt-% of at least one organic sulphur-additive, approximately 0.05 wt-% to approximately 1.5 wt-% of at least one organic phosphorus-additive and approximately 0.1 wt-% to approximately 2.0 wt-% of at least one anti-oxidation agent, in each case the wt-% referring to the total amount of the grease composition, whereat the at least one phosphorus-free molybdenum complex is preferably a molybdenum dithiocarbamate (MoDTC) in the solid state, whereat the MoDTC is preferably present in an amount of approximately 0.1 wt-% up to approximately 3.0 wt-%, further preferred in an amount of approximately 0.5 wt-% up to approximately 2.0 wt-%, in each case referred to the total amount of the grease composition in accordance with the present disclosure.

In an example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of zinc sulfide, approximately 0.1 wt-% to approximately 1.0 wt-% of at least one copper sulfide, approximately 1.0 wt-% to approximately 3.0 wt-% of molybdenum disulfide and/or tungsten disulfide, approximately 0.5 wt-% to approximately 0.7 wt-% of at least one organic sulphur-additive, approximately 0.2 wt-% to approximately 1.0 wt-% of at least one organic phosphorus-additive and approximately 0.2 wt-% to approximately 1.5 wt-% of at least one anti-oxidation agent, in each case the wt-% referring to the total amount of the grease composition.

In an example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of zinc sulfide, approximately 0.1 wt-% to approximately 1.0 wt-% of at least one copper sulfide, approximately 1.0 wt-% to approximately 3.0 wt-% of molybdenum disulfide and/or tungsten disulfide, approximately 0.5 wt-% to approximately 0.7 wt-% of at least one organic sulphur-additive, approximately 0.2 wt-% to approximately 1.0 wt-% of at least one organic phosphorus-additive and approximately 0.2 wt-% to approximately 1.5 wt-% of at least one anti-oxidation agent, in each case the wt-% referring to the total amount of the grease composition, whereat the at least one base oil comprises of poly-α-olefins and/or metal poly-α-olefins and/or naphthenic oils and/or paraffinic oils and/or polyether polyols and/or synthetic organic esters.

In an example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of zinc sulfide, approximately 0.1 wt-% to approximately 1.0 wt-% of at least one copper sulfide, approximately 1.0 wt-% to approximately 3.0 wt-% of molybdenum disulfide and/or tungsten disulfide, approximately 0.5 wt-% to approximately 0.7 wt-% of at least one organic sulphur-additive, approximately 0.2 wt-% to approximately 1.0 wt-% of at least one organic phosphorus-additive and approximately 0.2 wt-% to approximately 1.5 wt-% of at least one anti-oxidation agent, in each case the wt-% referring to the total amount of the grease composition, whereat the at least one base oil preferred comprises at least one paraffinic oil in an amount of approximately 30 wt-% up to approximately 85 wt-%, the latter amount referring to the total amount of the base oil, whereat the at least one paraffinic oil is preferably selected from a group comprising linear, branched or cyclic saturated alkanes of polyolefins, hydroisomerized Fischer-Tropsch wax, and Fischer-Tropsch oligomerized olefins, preferably isoparaffins, cycloparaffins containing mono-ring and/or multi-ring structures.

In an example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of zinc sulfide, approximately 0.1 wt-% to approximately 1.0 wt-% of at least one copper sulfide, approximately 1.0 wt-% to approximately 3.0 wt-% of molybdenum disulfide and/or tungsten disulfide, approximately 0.5 wt-% to approximately 0.7 wt-% of at least one organic sulphur-additive, approximately 0.2 wt-% to approximately 1.0 wt-% of at least one organic phosphorus-additive and approximately 0.2 wt-% to approximately 1.5 wt-% of at least one anti-oxidation agent, in each case the wt-% referring to the total amount of the grease composition, whereat the at least one base oil comprises at least one naphthenic oil in an amount approximately 15 wt-% up to approximately 80 wt-%, the wt-% referring to the total amount of the base oil, whereat the at least one naphthenic oil is preferably selected from a group comprising saturated cyclic alkanes.

In an example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of zinc sulfide, approximately 0.1 wt-% to approximately 1.0 wt-% of at least one copper sulfide, approximately 1.0 wt-% to approximately 3.0 wt-% of molybdenum disulfide and/or tungsten disulfide, approximately 0.5 wt-% to approximately 0.7 wt-% of at least one organic sulphur-additive, approximately 0.2 wt-% to approximately 1.0 wt-% of at least one organic phosphorus-additive and approximately 0.2 wt-% to approximately 1.5 wt-% of at least one anti-oxidation agent, in each case the wt-% referring to the total amount of the grease composition, whereat the at least one thickener is selected from a group comprising lithium soap thickener and urea thickener, preferably the lithium soap thickener is a reaction product of at least one fatty acid with lithium hydroxide and the urea thickener is at least one compound of diurea and/or polyurea.

In an example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of zinc sulfide, approximately 0.1 wt-% to approximately 1.0 wt-% of at least one copper sulfide, approximately 1.0 wt-% to approximately 3.0 wt-% of molybdenum disulfide and/or tungsten disulfide, approximately 0.5 wt-% to approximately 0.7 wt-% of at least one organic sulphur-additive, approximately 0.2 wt-% to approximately 1.0 wt-% of at least one organic phosphorus-additive and approximately 0.2 wt-% to approximately 1.5 wt-% of at least one anti-oxidation agent, in each case the wt-% referring to the total amount of the grease composition, whereat the zinc sulfide is comprised in a solid state.

In an example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of zinc sulfide, approximately 0.1 wt-% to approximately 1.0 wt-% of at least one copper sulfide, approximately 1.0 wt-% to approximately 3.0 wt-% of molybdenum disulfide and/or tungsten disulfide, approximately 0.5 wt-% to approximately 0.7 wt-% of at least one organic sulphur-additive, approximately 0.2 wt-% to approximately 1.0 wt-% of at least one organic phosphorus-additive and approximately 0.2 wt-% to approximately 1.5 wt-% of at least one anti-oxidation agent, in each case the wt-% referring to the total amount of the grease composition, whereat the at least one copper sulfide is preferably comprised as copper(II) sulfide (CuS) in a solid state.

In an example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of zinc sulfide, approximately 0.1 wt-% to approximately 1.0 wt-% of at least one copper sulfide, approximately 1.0 wt-% to approximately 3.0 wt-% of molybdenum disulfide and/or tungsten disulfide, approximately 0.5 wt-% to approximately 0.7 wt-% of at least one organic sulphur-additive, approximately 0.2 wt-% to approximately 1.0 wt-% of at least one organic phosphorus-additive and approximately 0.2 wt-% to approximately 1.5 wt-% of at least one anti-oxidation agent, in each case the wt-% referring to the total amount of the grease composition, whereat the molybdenum disulfide and/or tungsten disulfide is comprised in a solid state.

In an example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of zinc sulfide, approximately 0.1 wt-% to approximately 1.0 wt-% of at least one copper sulfide, approximately 1.0 wt-% to approximately 3.0 wt-% of molybdenum disulfide and/or tungsten disulfide, approximately 0.5 wt-% to approximately 0.7 wt-% of at least one organic sulphur-additive, approximately 0.2 wt-% to approximately 1.0 wt-% of at least one organic phosphorus-additive and approximately 0.2 wt-% to approximately 1.5 wt-% of at least one anti-oxidation agent, in each case the wt-% referring to the total amount of the grease composition, whereat the total amount of zinc sulfide and copper sulfide with molybdenum disulfide and/or tungsten disulfide is between approximately 0.5 wt-% up to approximately 7 wt-%, and further preferred approximately 1.0 wt-% up to approximately 4 wt-%, in each case the wt-% referring to the total amount of the grease composition.

In an example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of zinc sulfide, approximately 0.1 wt-% to approximately 1.0 wt-% of at least one copper sulfide, approximately 1.0 wt-% to approximately 3.0 wt-% of molybdenum disulfide and/or tungsten disulfide, approximately 0.5 wt-% to approximately 0.7 wt-% of at least one organic sulphur-additive, approximately 0.2 wt-% to approximately 1.0 wt-% of at least one organic phosphorus-additive and approximately 0.2 wt-% to approximately 1.5 wt-% of at least one anti-oxidation agent, in each case the wt-% referring to the total amount of the grease composition, whereat the at least one organic sulphur-additive comprises sulphur in an amount of at least 10 wt-%, and even more preferred approximately 20 wt-% up to approximately 70 wt-%, the wt-% referring to the total amount of the organic sulphur-additive, and whereat the at least one organic sulphur-additive is preferably selected from a group comprising at least one alkyl thiadiazole or an olefin sulfide made up of reaction products with olefin monomers as ethylene, propylene, butane-1 and/or 4-methylpentene.

In an example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of zinc sulfide, approximately 0.1 wt-% to approximately 1.0 wt-% of at least one copper sulfide, approximately 1.0 wt-% to approximately 3.0 wt-% of molybdenum disulfide and/or tungsten disulfide, approximately 0.5 wt-% to approximately 0.7 wt-% of at least one organic sulphur-additive, approximately 0.2 wt-% to approximately 1.0 wt-% of at least one organic phosphorus-additive and approximately 0.2 wt-% to approximately 1.5 wt-% of at least one anti-oxidation agent, in each case the wt-% referring to the total amount of the grease composition, whereat the at least one organic phosphorus-additive is preferably selected from a group comprising tri-substituted organic phosphates, further preferred iso-butyl phosphate (TiBP).

In an example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of zinc sulfide, approximately 0.1 wt-% to approximately 1.0 wt-% of at least one copper sulfide, approximately 1.0 wt-% to approximately 3.0 wt-% of molybdenum disulfide and/or tungsten disulfide, approximately 0.5 wt-% to approximately 0.7 wt-% of at least one organic sulphur-additive, approximately 0.2 wt-% to approximately 1.0 wt-% of at least one organic phosphorus-additive and approximately 0.2 wt-% to approximately 1.5 wt-% of at least one anti-oxidation agent, in each case the wt-% referring to the total amount of the grease composition, whereat the at least one anti-oxidation agent is preferably an amine, more preferably an aromatic amine, even more preferably benzamine and/or N-phenyl compounds reacted with 2,4,4-trimethylpentene or selected from the group of octylated/butylated diphenylamine, more preferably dioctyl diphenylamine, octyl diphenylamine, octyl/styrryl diphenylamine, diheptyl diphenylamine, dinonyl diphenylamine or a mixture thereof.

In an example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of zinc sulfide, approximately 0.1 wt-% to approximately 1.0 wt-% of at least one copper sulfide, approximately 1.0 wt-% to approximately 3.0 wt-% of molybdenum disulfide and/or tungsten disulfide, approximately 0.5 wt-% to approximately 0.7 wt-% of at least one organic sulphur-additive, approximately 0.2 wt-% to approximately 1.0 wt-% of at least one organic phosphorus-additive and approximately 0.2 wt-% to approximately 1.5 wt-% of at least one anti-oxidation agent, in each case the wt-% referring to the total amount of the grease composition, whereat the at least one phosphorus-free molybdenum complex is preferred a molybdenum dithiocarbamate (MoDTC) in a solid state, whereat the MoDTC is preferably present in an amount of approximately 0.1 wt-% up to approximately 3.0 wt-%, further preferred in an amount of approximately 0.5 wt-% up to approximately 2.0 wt-%, in each case referred to the total amount of the grease composition in accordance with the present disclosure.

In an example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of zinc sulfide, approximately 0.1 wt-% to approximately 1.0 wt-% of at least one copper sulfide, approximately 1.0 wt-% to approximately 3.0 wt-% of molybdenum disulfide and/or tungsten disulfide, approximately 0.5 wt-% to approximately 0.7 wt-% of at least one organic sulphur-additive, approximately 0.2 wt-% to approximately 1.0 wt-% of at least one organic phosphorus-additive and approximately 0.2 wt-% to approximately 1.5 wt-% of at least one anti-oxidation agent, in each case the wt-% referring to the total amount of the grease composition, whereat the at least one base oil comprises of poly-α-olefins and/or metal poly-α-olefins and/or naphthenic oils and/or paraffinic oils and/or polyether polyols and/or synthetic organic esters, whereat the at least one base oil preferably comprises of at least one paraffinic oil in an amount of approximately 30 wt-% up to approximately 85 wt-%, the wt-% referring to the total amount of the base oil, whereat the at least one paraffinic oil is preferably a selected from a group comprising linear, branched and cyclic saturated alkanes of polyolefins, hydroisomerized Fischer-Tropsch wax, and Fischer-Tropsch oligomerized olefins, preferably isoparaffins, cycloparaffins containing mono-ring and/or multi-ring structures, whereat the at least one base oil further comprises at least one naphthenic oil in an amount approximately 15 wt-% up to approximately 80 wt-%, the wt-% referring to the total amount of the base oil, whereat the at least one naphthenic oil is preferably selected from a group comprising saturated cyclic alkanes.

In an example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of zinc sulfide, approximately 0.1 wt-% to approximately 1.0 wt-% of at least one copper sulfide, approximately 1.0 wt-% to approximately 3.0 wt-% of molybdenum disulfide and/or tungsten disulfide, approximately 0.5 wt-% to approximately 0.7 wt-% of at least one organic sulphur-additive, approximately 0.2 wt-% to approximately 1.0 wt-% of at least one organic phosphorus-additive and approximately 0.2 wt-% to approximately 1.5 wt-% of at least one anti-oxidation agent, in each case the wt-% referring to the total amount of the grease composition, whereat zinc sulfide and copper sulfide with molybdenum disulfide and/or tungsten disulfide are preferably comprised in a solid state, whereat the total amount of zinc sulfide and copper sulfide with molybdenum disulfide and/or tungsten disulfide is between approximately 0.5 wt-% up to approximately 7 wt-%, and further preferred approximately 1.0 wt-% up to approximately 4 wt-%, in each case the wt-% referring to the total amount of the grease composition.

In an example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of zinc sulfide, approximately 0.1 wt-% to approximately 1.0 wt-% of at least one copper sulfide, approximately 1.0 wt-% to approximately 3.0 wt-% of molybdenum disulfide and/or tungsten disulfide, approximately 0.5 wt-% to approximately 0.7 wt-% of at least one organic sulphur-additive, approximately 0.2 wt-% to approximately 1.0 wt-% of at least one organic phosphorus-additive and approximately 0.2 wt-% to approximately 1.5 wt-% of at least one anti-oxidation agent, in each case the wt-% referring to the total amount of the grease composition, whereat the at least one organic sulphur-additive comprises sulphur in an amount of at least 10 wt-%, and even more preferred between approximately 20 wt-% up to approximately 70 wt-%, the wt-% referring to the total amount of the organic sulphur-additive, and whereat the at least one organic sulphur-additive is preferably selected from a group comprising at least one alkyl thiadiazole or an olefin sulfide made up of reaction products with olefin monomers as ethylene, propylene, butane-1 and/or 4-methylpentene, whereat at least one organic phosphorus-additive is preferably present in an amount of approximately 0.2 wt-% up to approximately 2.0 wt-%, further preferred in an amount of approximately 0.3 wt-% up to approximately 1.0 wt-%, in each case the wt-% referring to the total amount of the grease composition, whereat the at least one organic phosphorus-additive is preferably selected from a group comprising tri-substituted organic phosphates, further preferred iso-butyl phosphate (TiBP), whereat the at least one anti-oxidation agent is preferably an amine, more preferably an aromatic amine, even more preferably benzamine and/or N-phenyl compounds reacted with 2,4,4-trimethylpentene or selected from the group of octylated/butylated diphenylamine, more preferably dioctyl diphenylamine, octyl diphenylamine, octyl/styrryl diphenylamine, diheptyl diphenylamine, dinonyl diphenylamine or a mixture thereof, whereat the at least one phosphorus-free molybdenum complex is preferred a molybdenum dithiocarbamate (MoDTC) is in a solid state, whereat the MoDTC is preferably present in an amount of approximately 0.1 wt-% up to approximately 3.0 wt-%, further preferred in an amount of approximately 0.5 wt-% up to approximately 2.0 wt-%, in each case referred to the total amount of the grease composition in accordance with the present disclosure.

In an example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of zinc sulfide, approximately 0.1 wt-% to approximately 1.0 wt-% of at least one copper sulfide, approximately 1.0 wt-% to approximately 3.0 wt-% of molybdenum disulfide and/or tungsten disulfide, approximately 0.5 wt-% to approximately 0.7 wt-% of at least one organic sulphur-additive, approximately 0.2 wt-% to approximately 1.0 wt-% of at least one organic phosphorus-additive and approximately 0.2 wt-% to approximately 1.5 wt-% of at least one anti-oxidation agent, in each case the wt-% referring to the total amount of the grease composition, whereat the at least one base oil comprises of poly-α-olefins and/or metal poly-α-olefins and/or naphthenic oils and/or paraffinic oils and/or polyether polyols and/or synthetic organic esters, whereat the at least one base oil preferably comprises of at least one paraffinic oil in an amount of approximately 30 wt-% up to approximately 85 wt-%, the wt-% referring to the total amount of the base oil, whereat the at least one paraffinic oil is preferably a selected from a group comprising linear, branched and cyclic saturated alkanes of polyolefins, hydroisomerized Fischer-Tropsch wax, and Fischer-Tropsch oligomerized olefins, preferably isoparaffins, cycloparaffins containing mono-ring and/or multi-ring structures, whereat the at least one base oil further comprises at least one naphthenic oil in an amount approximately 15 wt-% up to approximately 80 wt-%, the wt-% referring to the total amount of the base oil, whereat the naphthenic oil is preferably selected from a group comprising saturated cyclic alkanes, whereat zinc sulfide and copper sulfide with molybdenum disulfide and/or tungsten disulfide are preferably comprised in a solid state, whereat the total amount of zinc sulfide and copper sulfide with molybdenum disulfide and/or tungsten disulfide is between approximately 0.5 wt-% up to approximately 7 wt-%, and further preferred approximately 1.0 wt-% up to approximately 4 wt-%, in each case the wt-% referring to the total amount of the grease composition and whereat the at least one organic sulphur-additive comprises sulphur in an amount of at least 10 wt-%, and even more preferred between approximately 20 wt-% up to approximately 70 wt-%, the wt-% referring to the total amount of the organic sulphur-additive, and whereat the at least one organic sulphur-additive is preferably selected from a group comprising at least one alkyl thiadiazole or an olefin sulfide made up of reaction products with olefin monomers as ethylene, propylene, butane-1 and/or 4-methylpentene, whereat at least one organic phosphorus-additive is preferably present in an amount of approximately 0.2 wt-% up to approximately 2.0 wt-%, further preferred in an amount of approximately 0.3 wt-% up to approximately 1.0 wt-%, in each case the wt-% referring to the total amount of the grease composition, whereat the at least one organic phosphorus-additive is preferably selected from a group comprising tri-substituted organic phosphates, further preferred iso-butyl phosphate (TiBP), whereat the at least one anti-oxidation agent is preferably an amine, more preferably an aromatic amine, even more preferably benzamine and/or N-phenyl compounds reacted with 2,4,4-trimethylpentene or selected from the group of octylated/butylated diphenylamine, more preferably dioctyl diphenylamine, octyl diphenylamine, octyl/styrryl diphenylamine, diheptyl diphenylamine, dinonyl diphenylamine or a mixture thereof, whereat the at least one phosphorus-free molybdenum complex is preferred a molybdenum dithiocarbamate (MoDTC), whereat the at least one MoDTC is preferred comprised in a solid state, whereat the at least one MoDTC is preferably present in an amount of approximately 0.1 wt-% up to approximately 3.0 wt-%, further preferred in an amount of approximately 0.5 wt-% up to approximately 2.0 wt-%, in each case referred to the total amount of the grease composition in accordance with the present disclosure.

A grease composition for use in constant velocity joints which comprises at least one base oil, at least one thickener, zinc sulfide, at least one copper sulfide, molybdenum disulfide and/or tungsten disulfide, at least one organic sulphur-additive, at least one organic phosphorus-additive and at least one anti-oxidation agent, whereat the total amount of zinc sulfide and copper sulfide with molybdenum disulfide and/or tungsten disulfide preferably is comprised in an amount of approximately 0.5 wt-% up to approximately 7 wt-% at the most, in each case the wt-% referring to the total amount of the grease composition.

A grease composition for use in constant velocity joints which comprises at least one base oil, at least one thickener, zinc sulfide, at least one copper sulfide, molybdenum disulfide and/or tungsten disulfide, at least one organic sulphur-additive, at least one organic phosphorus-additive and at least one anti-oxidation agent, whereat the total amount of zinc sulfide and copper sulfide with molybdenum disulfide and/or tungsten disulfide preferably is comprised in an amount of approximately 0.5 wt-% up to approximately 7 wt-% at the most, whereat the at least one base oil is comprised in an amount of approximately 60 wt-% up to approximately 90 wt-% in each case the wt-% referring to the total amount of the grease composition.

A grease composition for use in constant velocity joints which comprises at least one base oil, at least one thickener, zinc sulfide, at least one copper sulfide, molybdenum disulfide and/or tungsten disulfide, at least one organic sulphur-additive, at least one organic phosphorus-additive and at least one anti-oxidation agent, whereat the total amount of zinc sulfide and copper sulfide with molybdenum disulfide and/or tungsten disulfide preferably is comprised in an amount of approximately 0.5 wt-% up to approximately 7 wt-% at the most, in each case the wt-% referring to the total amount of the grease composition, whereat the at least one base oil comprises poly-α-olefines, metal poly-α-olefines, naphthenic oils, paraffinic oils, polyether polyols and/or synthetic organic esters.

A grease composition for use in constant velocity joints which comprises at least one base oil, at least one thickener, zinc sulfide, at least one copper sulfide, molybdenum disulfide and/or tungsten disulfide, at least one organic sulphur-additive, at least one organic phosphorus-additive and at least one anti-oxidation agent, whereat the total amount of zinc sulfide and copper sulfide with molybdenum disulfide and/or tungsten disulfide preferably is comprised in an amount of approximately 0.5 wt-% up to approximately 7 wt-% at the most, in each case the wt-% referring to the total amount of the grease composition, whereat the at least one base oil comprises at least one paraffinic oil in an amount of approximately 30 wt-% up to approximately 85 wt-%, and/or whereat the at least one base oil may further comprise at least one naphthenic oil in an amount of approximately 15 wt-% up to approximately 70 wt-%, the wt-% referring to the total amount of the base oil.

A grease composition for use in constant velocity joints which comprises at least one base oil, at least one thickener, zinc sulfide, at least one copper sulfide, molybdenum disulfide and/or tungsten disulfide, at least one organic sulphur-additive, at least one organic phosphorus-additive and at least one anti-oxidation agent, whereat the total amount of zinc sulfide and copper sulfide with molybdenum disulfide and/or tungsten disulfide preferably is comprised in an amount of approximately 0.5 wt-% up to approximately 7 wt-% at the most, characterized in that zinc sulfide is comprised in an amount of approximately 0.05 wt-% up to approximately 2.0 wt-%, in each case the wt-% referring to the total amount of the grease composition.

A grease composition for use in constant velocity joints which comprises at least one base oil, at least one thickener, zinc sulfide, at least one copper sulfide, molybdenum disulfide and/or tungsten disulfide, at least one organic sulphur-additive, at least one organic phosphorus-additive and at least one anti-oxidation agent, whereat the total amount of zinc sulfide and copper sulfide with molybdenum disulfide and/or tungsten disulfide preferably is comprised in an amount of approximately 0.5 wt-% up to approximately 7 wt-% at the most, characterized in that the at least one copper sulfide is comprised in an amount of approximately 0.01 wt-% up to approximately 1.5 wt-%, in each case the wt-% referring to the total amount of the grease composition.

A grease composition for use in constant velocity joints which comprises at least one base oil, at least one thickener, zinc sulfide, at least one copper sulfide, molybdenum disulfide and/or tungsten disulfide, at least one organic sulphur-additive, at least one organic phosphorus-additive and at least one anti-oxidation agent, whereat the total amount of zinc sulfide and copper sulfide with molybdenum disulfide and/or tungsten disulfide preferably is comprised in an amount of approximately 0.5 wt-% up to approximately 7 wt-% at the most, characterized in that molybdenum disulfide and/or tungsten disulfide is comprised in an amount of approximately 0.5 wt-% up to approximately 5.0 wt-%, in each case the wt-% referring to the total amount of the grease composition.

A grease composition for use in constant velocity joints which comprises at least one base oil, at least one thickener, zinc sulfide, at least one copper sulfide, molybdenum disulfide and/or tungsten disulfide, at least one organic sulphur-additive, at least one organic phosphorus-additive and at least one anti-oxidation agent, whereat the total amount of zinc sulfide and copper sulfide with molybdenum disulfide and/or tungsten disulfide preferably is comprised in an amount of approximately 0.5 wt-% up to approximately 7 wt-% at the most, in each case the wt-% referring to the total amount of the grease composition, whereat the at least one organic sulphur-additive is comprised in an amount of approximately 0.2 wt-% up to approximately 1.0 wt-%, in each case the wt-% referring to the total amount of the grease composition, and whereat the at least one organic sulphur-additive comprises sulphur in an amount of at least 10 wt-%, the wt-% referring to the total amount of the organic sulphur-additive.

A grease composition for use in constant velocity joints which comprises at least one base oil, at least one thickener, zinc sulfide, at least one copper sulfide, molybdenum disulfide and/or tungsten disulfide, at least one organic sulphur-additive, at least one organic phosphorus-additive and at least one anti-oxidation agent, whereat the total amount of zinc sulfide and copper sulfide with molybdenum disulfide and/or tungsten disulfide preferably is comprised in an amount of approximately 0.5 wt-% up to approximately 7 wt-% at the most, whereat the at least one organic phosphorus-additive is comprised in an amount of approximately 0.05 wt-% up to approximately 1.5 wt-%, in each case the wt-% referring to the total amount of the grease composition.

A grease composition for use in constant velocity joints which comprises at least one base oil, at least one thickener, zinc sulfide, at least one copper sulfide, molybdenum disulfide and/or tungsten disulfide, at least one organic sulphur-additive, at least one organic phosphorus-additive and at least one anti-oxidation agent, whereat the total amount of zinc sulfide and copper sulfide with molybdenum disulfide and/or tungsten disulfide preferably is comprised in an amount of approximately 0.5 wt-% up to approximately 7 wt-% at the most, whereat the at least one anti-oxidation agent is comprised in an amount of approximately 0.1 wt-% up to approximately 2.0 wt-%, in each case the wt-% referring to the total amount of the grease composition.

A grease composition for use in constant velocity joints which comprises at least one base oil, at least one thickener, zinc sulfide, at least one copper sulfide, molybdenum disulfide and/or tungsten disulfide, at least one organic sulphur-additive, at least one organic phosphorus-additive and at least one anti-oxidation agent, whereat the total amount of zinc sulfide and copper sulfide with molybdenum disulfide and/or tungsten disulfide preferably is comprised in an amount of approximately 0.5 wt-% up to approximately 7 wt-% at the most, whereat the at least one phosphorus-free molybdenum complex, preferably a molybdenum dithiocarbamate (MoDTC), is preferably present in an amount of approximately 0.1 wt-% up to approximately 3.0 wt-%, in each case referred to the total amount of the grease composition in accordance with the present disclosure.

A grease composition for use in constant velocity joints which comprises at least one base oil, at least one thickener, zinc sulfide, at least one copper sulfide, molybdenum disulfide and/or tungsten disulfide, at least one organic sulphur-additive, at least one organic phosphorus-additive and at least one anti-oxidation agent, whereat the total amount of zinc sulfide and copper sulfide with molybdenum disulfide and/or tungsten disulfide preferably is approximately 0.5 wt-% up to approximately 4 wt-% at the most, in each case the wt-% referring to the total amount of the grease composition.

A grease composition for use in constant velocity joints which comprises at least one base oil, at least one thickener, zinc sulfide, at least one copper sulfide, molybdenum disulfide and/or tungsten disulfide, at least one organic sulphur-additive, at least one organic phosphorus-additive and at least one anti-oxidation agent, whereat the total amount of zinc sulfide and copper sulfide with molybdenum disulfide and/or tungsten disulfide preferably is approximately 1.0 wt-% up to approximately 7 wt-% at the most, in each case the wt-% referring to the total amount of the grease composition.

In the sense of this disclosure, molybdenum disulfide as mentioned in the examples may be comprised from the grease composition of this disclosure in combination with tungsten disulfide ($WS_2$), whereat the tungsten disulfide partly replaces the amount of molybdenum disulfide within the wt-% ranges in accordance with the present disclosure. The above-mentioned examples of the grease composition are non-limitative examples whereby different combination of the said ranges and additives are also possible.

The grease composition will be hereunder described in more detail with reference to the following non-limiting examples in accordance with the present disclosure and comparative examples of various grease compositions.

In order to determine the effect of lowering the friction coefficient as well as the wear by the grease composition according to this disclosure, Schwingungs-Reibverschleiß SRV tests are carried out using an Optimol Instruments SRV tester. Flat disc lower specimen made of the 100Cr6 standard bearing steel from Optimol Instruments Prüftechnik GmbH, Westendstrasse 125, Munich, properly cleaned using a solvent are prepared and contacted with the grease composition to be examined. The SRV test is an industry standard test and is especially relevant for the testing of greases for CV joint. The test consists of an upper ball specimen with a diameter of 10 mm made from 100Cr6 bearing steel reciprocating under load on the flat disc lower specimen indicated above. In tests for mimicking ball joints a frequency of 40 Hz with an applied load of 500 N were applied for 60 minutes (including running-in) at 80° C. The stroke was 1.5 mm. The friction coefficients obtained were recorded on computer. For each grease, the reported value is an average of two data at the end of tests in two runs. For the running-in measurement of the friction coefficient, it is started with an applied load of 50 N for 1 minute under the above-specified conditions. Afterwards, the applied load is increased for 30 seconds by 50 N up to 500 N. Wear is measured using a profilometer and a digital planimeter. By using the profilometer, a profile of the cross section in the middle of the worn surfaces can be obtained. The area (S) of this cross section can be measured by using the digital planimeter. The wear quantity is assessed by V=SI, where V is the volume of the wear and I is the stroke. The wear rate ($W_r$) is obtained from $W_r$=V/L [$\mu m^3/m$], where L is the total sliding distance in the tests.

A Standard Multi Block Program SMBP Test is used to compare and evaluate the life endurance characteristics of CV joints. A CV joint is exposed to a torque at an acceleration rate of 250 Nm/sec, a jounce deflection at a rate of 100 mm/sec and a rotation speed at an acceleration rate of at least 40 rpm/sec to maximum values of at least 1000 Nm and 2000 rpm. During the program, a permanent record of the actual torque, speed and jounce deflection (angle) will be given by a test rig. The program will run defined load cycles until the CV joint gets a first sign of significant impairments. One cycle is defined by 51.3 min and 39973 revolutions. The life endurance is evaluated by the accomplished cycles until failure of the CV joint. A failure is defined as an overproportioned temperature increase or appearance of noises indicating wear. The CV joint life endurance is valuated by the number of accomplished cycles until the failure of the CV joint. For better statistical power up to 4 CV joint containing the same grease composition are tested simultaneously. When 4 out of 4 CV joints failed, the testing is completed and the overall cycles are counted. As comparison a commercial grease is used.

Further, tests regarding the compatibility properties of a thermoplastic elastomer sealing boot, i.e. Pibiflex B5050 MWR, carried out with a grease composition in accordance with the present disclosure and with one commercial grease, i.e. commercial grease composition C1 (see Table 3), were carried out with respect to the change of hardness (shore D) and the percentage change of tensile, elongation, and volume before and after a heat ageing of the sealing boot material immersed in the grease at 125° C. for 336 hours. Said values are measured in accordance with ISO 868 (shore D), ISO 37 (tensile change and elongation change), and ISO 2781 (volume change).

The base oil as used for grease compositions A1 to A2 and B1 to B3 consists of a paraffinic oil in an amount of 82.8 wt-% up to 83.2 wt-% and a naphthenic oil in an amount of 16.8 wt-% up to 17.2 wt-%, in each case the wt-% referring to the total amount of the base oil. The base oil as used for grease composition A3 consists of a poly-α-olefin in an amount of 23.9 wt-% and a naphthenic oil in an amount of 76.1 wt-%, in each case the wt-% referring to the total amount of the base oil.

The following compounds were used in the grease compositions of Table 1 to Table 3. The commercial grease C1 is comprising a base oil, a Li-soap oil of 8 wt-%, $MoS_2$ in an amount about 2.7 wt-%, and an anti-oxidation agent of about 0.5 wt-%, in each case the wt-% referring to the total amount of the commercial grease. The commercial grease C2 is comprising a base oil, a urea-thickener, $MoS_2$ in an amount about 1.0 wt-%, MoDTC in an amount about 1.5 wt-%, an organic sulphur-additive in an amount about 0.5 wt-%, and an anti-oxidation agent in an amount about 0.3 wt-%, in each case the wt-% referring to the total amount of the commercial grease. The commercial greases C1 and C2 result in the sum of all compounds whether explicitly defined or not exactly defined 100% by weight including additives not mentioned.

Zinc sulfide (ZnS) powder having a purity of 97 wt-% and an average particle size of 0.80 μm was used. As Copper(II) sulfide (CuS) powder having a particle size $D_{90}$ 15 μm was used. Copper(II) sulfide obtainable as CB 700 from Tribotecc GmbH, Kearntner Str. 7, 1010 Vienna, Austria was used. A Super fine Molybdenum disulfide ($MoS_2$) powder having a purity of 97 wt-% and a particle size of 0.40 up to 0.50 μm (Fischer No.) was used. A tungsten disulfide ($WS_2$) powder having an average particle size of 7 μm as $D_{90}$ was used. As an organic sulphur-additive, Anglamol 33 from Lubrizol France, 25 Quai de France, 76173 Rouen Cedex, France was used. As an organic phosphorus-additive Tri-iso-butylphosphate with a purity of 99 wt-% from Lanxess AG, Kennedyplatz 1, 50569 Cologne, Germany was employed. As a Li soap thickener, Lithium stearate obtained by reaction of 12-hydroxystearic acid with Lithium hydroxide (LiOH) was used. The used urea thickener was obtained by reaction of 4,4'-diphenylmethane diisocyanate with hydrogenated tallow fatty amines. As an anti-oxidation agent, Irganox L57 from BASF SE, 67056 Ludwigshafen, Germany was used. As a phosphorus-free molybdenum complex Molybdenum dithiocarbamte (MoDTC), obtainable under the commercial name Sakuralube 600 from Adeka, was used.

Commercial greases are in the following designated as C1 and C2, whereas the grease compositions comprising molybdenum disulfide additionally to zinc sulfide and copper sulfide are designated as A1 and A2, whereat the grease composition comprising tungsten additionally to zinc sulfide and copper sulfide disulfide is designated as A3 and the grease compositions designated as B1 to B3 are comparative samples.

TABLE 1

| [wt-%] | C1 | C2 | A1 | A2 | A3 | B1 | B2 | B3 |
|---|---|---|---|---|---|---|---|---|
| Thickener: Li soap | 8 | — | 8 | 8 | — | 8 | 8 | 8 |
| Urea thickener | — | 7 | — | — | 12 | — | — | — |
| Base oil (sum up) | yes | yes | 87.5 | 87.5 | 83.8 | 87.5 | 87.5 | 89.05 |
| Paraffinic oils in base oil | n.d | n.d | 72.5 | 72.5 | 0 | 72.5 | 72.5 | 74.05 |
| Naphthenic oils in base oil | n.d | n.d | 15 | 15 | 63.8 | 15 | 15 | 15 |
| Poly-α-olefin | n.d | n.d | 0 | 0 | 20.0 | 0 | 0 | 0 |
| ZnS | 0 | 0 | 0.25 | 0.25 | 0.25 | 0 | 0.5 | 0.25 |
| CuS | 0 | 0 | 0.25 | 0.25 | 0.25 | 0.5 | 0 | 0 |
| $MoS_2$ | 2.7 | 1.0 | 1.0 | 2.0 | 0 | 1.0 | 2.0 | 0 |
| $WS_2$ | 0 | 0 | 0 | 0 | 1.7 | 0 | 0 | 1.7 |
| organic sulphur-additive | 0 | 0.5 | 0.5 | 0.5 | 0.5 | 0.5 | 0.5 | 0.5 |
| organic phosphor-additive | 0 | 0 | 0 | 0.5 | 0.5 | 0 | 0.5 | 0.5 |
| Anti-oxidation agent | 0.5 | 0.3 | 1.0 | 1.0 | 1.0 | 1.0 | 1.0 | 1.0 |
| MoDTC | 0 | 1.5 | 1.5 | 0 | 0 | 1.5 | 0 | 0 |

n.d. not defined

Figure 1B:
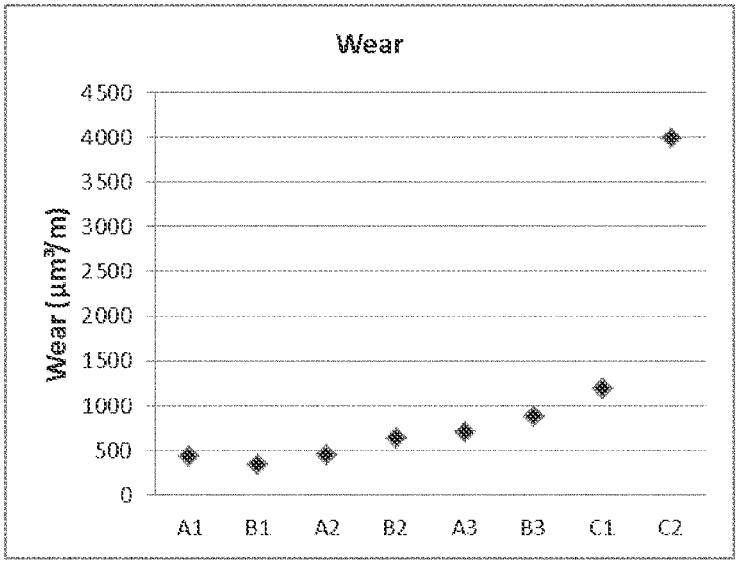

Experimental results regarding the friction coefficient of the grease compositions according to this disclosure, wear of the grease compositions and life endurance (SMBP test) of the grease compositions as compared to commercial greases C1 and C2 are presented in Table 2 and FIG. 1*a*, 1*b*, 2 and 3. The Figures show:

FIGS. 1*a* and 1*b*: Experimental results for friction and wear, respectively, as presented in Table 2, are shown for the additive effect of zinc sulfide in combination with copper sulfide in compositions B1 to B3 and the commercial greases C1 and C2 in comparison with the grease compositions A1, A2 and A3.

Figure 2:
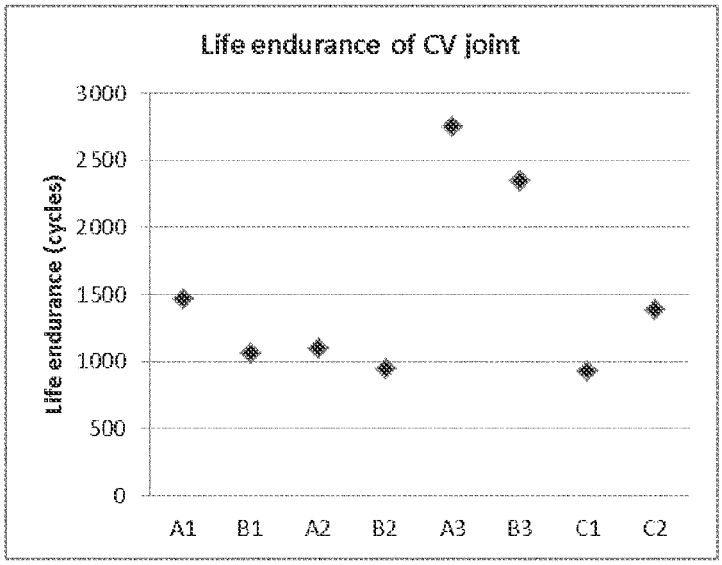
FIG. 2 is a plot of experimental results for life endurance of a constant velocity joint for the plurality of grease compositions.

FIG. 2: Experimental results for the life endurance of a CV joint, as presented in Table 2, are shown for the grease compositions A1, A2 and A3 in comparison with the commercial greases C1 and C2.

Figure 3:
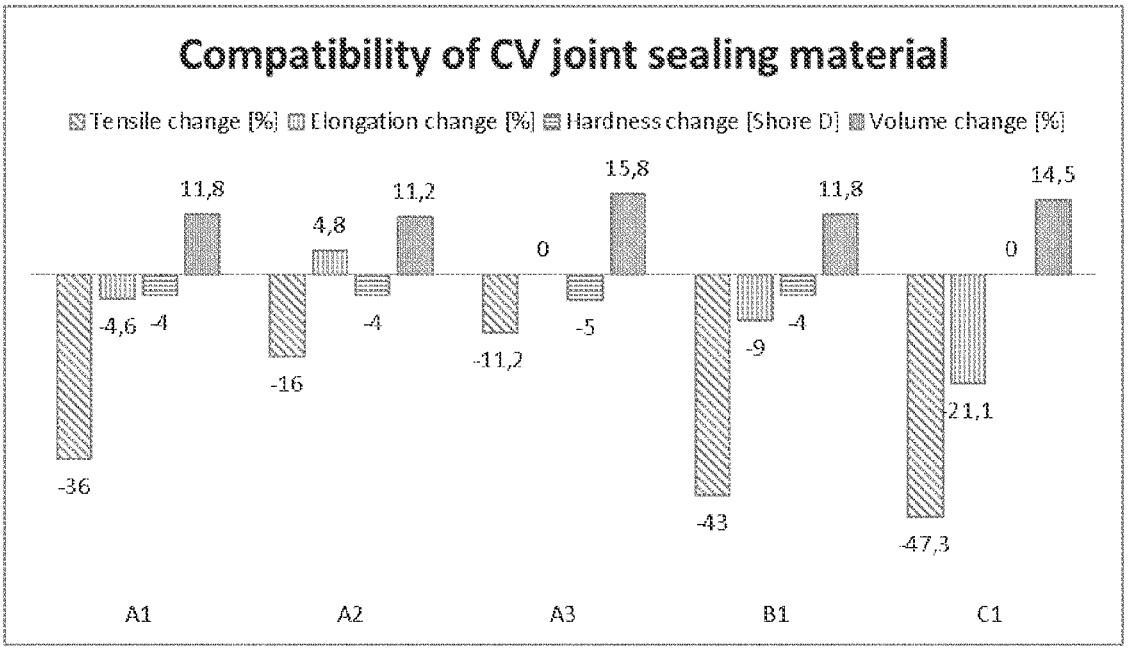
FIG. 3 is a plot of experimental results for a compatibility test of sealing boot material for some of the plurality of grease compositions.

FIG. 3: Experimental results, as presented in Table 3, for the compatibility test of sealing boot material of the grease compositions A1, A2 and A3 in comparison with the commercial grease C1.

Experimental results regarding the friction coefficient, wear quantity and the life endurance of a CV joint of the three grease compositions A1, A2 and A3 compared to grease composition B1 to B3 and the commercial greases C1 and C2 are presented in Table 2.

TABLE 2

| | C1 | C2 | A1 | A2 | A3 | B1 | B2 | B3 |
|---|---|---|---|---|---|---|---|---|
| Thickener: Li soap | 8 | — | 8 | 8 | — | 8 | 8 | 8 |
| Urea thickener | — | 7 | — | — | 12 | — | — | — |
| ZnS | 0 | 0 | 0.25 | 0.25 | 0.25 | 0 | 0.5 | 0.25 |
| CuS | 0 | 0 | 0.25 | 0.25 | 0.25 | 0.5 | 0 | 0 |
| $MoS_2$ | 2.7 | 1.0 | 1.0 | 2.0 | 0 | 1.0 | 2.0 | 0 |
| $WS_2$ | 0 | 0 | 0 | 0 | 1.7 | 0 | 0 | 1.7 |
| organic sulphur-additive | 0 | 0.5 | 0.5 | 0.5 | 0.5 | 0.5 | 0.5 | 0.5 |
| organic phosphor-additive | 0 | 0 | 0 | 0.5 | 0.5 | 0 | 0.5 | 0.5 |
| MoDTC | 0 | 1.5 | 1.5 | 0 | 0 | 1.5 | 0 | 0 |
| Friction coefficient | 0.105 | 0.100 | 0.043 | 0.055 | 0.099 | 0.052 | 0.044 | 0.109 |
| Wear quantity [$\mu m^3/m$] | 1181 | 3993 | 431 | 451 | 707 | 340 | 639 | 882 |
| Life endurance [cycles] | 925 | 1386 | 1465 | 1094 | 2746 | 1061 | 943 | 2342 |

Table 2 and FIG. 1*a*, 1*b* and 2 show the experimental results of the grease compositions A1 and A2 comprising zinc sulfide, copper sulfide and molybdenum disulfide in accordance with the present disclosure in comparison with zinc-free grease B1, copper-free grease B2 and the commercial grease C1. The grease compositions A1 and A2 show good values for friction and wear. However, adding zinc sulfide in combination with copper sulfide, molybdenum disulfide, organic sulphur-additive, organic phosphorus-additive and phosphorus-free molybdenum dithiocarbamate (MoDTC), there is a reduction of the friction coefficient from 0.052 to 0.043, which is the lowest achieved friction coefficient. A1, A2 as well as B1 and B2 show lower friction coefficients', higher anti-wear performance and significant improved life endurance in comparison to the commercial grease composition C1. The combination of zinc sulfide and copper sulfide in the grease composition A1 show a considerable improved anti-wear performance, significant higher life endurance and a lower friction coefficient in comparison to the zinc-free grease composition B1, which suggests a synergistic effect between zinc sulfide and copper sulfide.

Table 2 and FIG. 1*a*, 1*b* and 2 show the experimental results of the grease compositions A3 comprising zinc sulfide, copper sulfide and tungsten disulfide in accordance with the present disclosure in comparison with copper-free grease B3 and the commercial grease C2. The friction coefficient of the grease A3, the copper-free grease B3 and the commercial grease compositions C1 and C2 are similar. The anti-wear performance of the grease A3 and the copper-free grease B3 is significant improved in comparison to the commercial grease compositions C1 and C2. The life endurance of the grease A3 is considerable improved in comparison to the copper-free grease B3. Not only adding copper sulfide, but also using a urea thickener instead a lithium soap thickener in A3 lead to considerable improved life endurance in the CV joint. These results show a synergistic effect between zinc sulfide, copper sulfide and tungsten disulfide in a grease composition.

Experimental results regarding the compatibility of the grease composition with sealing boot materials as compared to commercial grease C1 are presented in Table 3 and FIG. 3.

TABLE 3

| Compatibility Test for sealing boot material | | | | | |
|---|---|---|---|---|---|
| | A1 | A2 | A3 | B1 | C1 |
| ZnS | 0.25 | 0.25 | 0.25 | — | — |
| CuS | 0.25 | 0.25 | 0.25 | 0.5 | — |
| $MoS_2$ | 1.0 | 2.0 | — | 1.0 | 2.7 |

TABLE 3-continued

| Compatibility Test for sealing boot material | | | | | |
|---|---|---|---|---|---|
| | A1 | A2 | A3 | B1 | C1 |
| $WS_2$ | — | — | 1.7 | — | — |
| MoDTC | 1.5 | — | — | 1.5 | — |
| Tensile change [%] | −36 | −16 | −11.3 | −43 | −47.3 |
| Elongation change [%] | −4.6 | 4.8 | 0 | −9 | −21.1 |
| Hardness change [Shore D] | −4 | −4 | −5 | −4 | 0 |
| Volume change [%] | 11.8 | 11.2 | 15.8 | 11.8 | 14.5 |

n.d.—not detected

Table 3 and FIG. 3 show the experimental results of the sealing boot material tested with the grease compositions A1, A2 and A3 in the compatibility test for an indication of material degradation related to lifetime of the sealing boot material in applications in comparison with the zinc-free grease composition B1 and the commercial grease C1. All three grease compositions A1, A2 and A3 show a considerable improvement in compatibility with sealing boot material. The positive impact of zinc sulfide (ZnS) and copper(II) sulfide (CuS) is shown in comparison with the zinc-free grease composition B1. Especially A3 shows an overall improvement of the compatibility of the grease composition with the sealing boot material.

The examples of the grease compositions in accordance with this disclosure clearly demonstrate that the combination of zinc sulfide and copper sulfide with molybdenum disulfide and/or tungsten disulfide retains the general lubricating properties of the grease composition, but in addition increases the life endurance and the compatibility of the CV joint.

The invention claimed is:

1. A grease composition for use in constant velocity joints comprising a) at least one base oil;

b) at least one thickener;

c) zinc sulfide in an amount between approximately 0.05 wt-% and approximately 2.0 wt-% of a total amount of the grease composition;

d) at least one copper sulfide in an amount between approximately 0.01 wt-% and approximately 1.5 wt-% of the total amount of the grease composition; and e) molybdenum disulfide and/or tungsten disulfide in an amount between approximately 0.5 wt-% and approximately 5.0 wt-% of the total amount of the grease composition.

2. The grease composition of claim 1, wherein a total amount of zinc sulfide, copper sulfide, and molybdenum disulfide and/or tungsten disulfide is in an amount between approximately 0.5 wt-% and approximately 7 wt-% of the total amount of the grease composition.

3. The grease composition of claim 1, wherein the at least one copper sulfide is copper(II) sulfide (CuS).

4. The grease composition of claim 1, further comprising at least one organic sulphur-additive in an amount between approximately 0.1 wt-% and approximately 1.5 wt-% of the total amount of the grease composition.

5. The grease composition of claim 4, wherein the at least one organic sulphur-additive comprises sulphur in an amount of at least 10 wt-% of the total amount of the organic sulphur-additive.

6. The grease composition of claim 1, further comprising at least one organic phosphorus-additive in an amount between approximately 0.05 wt-% and approximately 1.5 wt-% of the total amount of the grease composition.

7. The grease composition of claim 1, further comprising at least one anti-oxidation agent in an amount between approximately 0.1 wt-% and approximately 2.0 wt-% of the total amount of the grease composition.

8. The grease composition of claim 1, wherein the at least one thickener is selected from a group consisting of at least one urea thickener, at least one lithium soap, and/or at least one lithium complex soap.

9. The grease composition of claim 1, further comprising at least one phosphorus-free molybdenum complex in an amount between approximately 0.1 wt-% and approximately 3.0 wt-% of the total amount of the grease composition.

10. The grease composition of claim 1, wherein the at least one base oil comprises poly-α-olefins, metal poly-α-olefins, naphthenic oils, paraffinic oils, polyether polyols and/or synthetic organic esters.

11. The grease composition of claim 1, wherein the at least one base oil comprises at least one paraffinic oil in an amount between approximately 30 wt-% and approximately 85 wt-% of the total amount of the base oil.

12. The grease composition of claim 1, wherein the at least one base oil comprises at least one naphthenic oil in an amount between approximately 15 wt-% and approximately 80 wt-% of the total amount of the base oil.

13. The grease composition of claim 1, further comprising:

at least one organic sulphur-additive in an amount between approximately 0.1 wt-% and approximately 1.5 wt-% of the total amount of the grease composition; and at least one organic phosphorus-additive in an amount between approximately 0.05 wt-% and approximately 1.5 wt-% of the total amount of the grease composition;

wherein the at least one base oil is in an amount between approximately 60 wt-% and approximately 95 wt-% of the total amount of the grease composition;

the at least one thickener is in an amount between approximately 2 wt-% and approximately 20 wt-% of the total amount of the grease composition;

the zinc sulfide is in an amount between approximately 0.05 wt-% and approximately 2.0 wt-% of the total amount of the grease composition;

the at least one copper sulfide is in an amount between approximately 0.01 wt-% and approximately 1.5 wt-% of the total amount of the grease composition; and the molybdenum disulfide and/or tungsten disulfide is in an amount between approximately 0.5 wt-% and approximately 5.0 wt-% of the total amount of the grease composition.

14. A method comprising:

providing a grease composition comprising:

a) at least one base oil;

b) at least one thickener;

c) zinc sulfide in an amount between approximately 0.05 wt-% and approximately 2.0 wt-% of a total amount of the grease composition;

d) at least one copper sulfide in an amount between approximately 0.01 wt-% and approximately 1.5 wt-% of the total amount of the grease composition; and e) molybdenum disulfide and/or tungsten disulfide in an amount between approximately 0.5 wt-% and approximately 5.0 wt-% of the total amount of the grease composition; and filling a constant velocity joint with the grease composition.

15. A constant velocity joint comprising:

a grease composition comprising:

a) at least one base oil;

b) at least one thickener;

c) zinc sulfide in an amount between approximately 0.05 wt-% and approximately 2.0 wt-% of a total amount of the grease composition;

d) at least one copper sulfide in an amount between approximately 0.01 wt-% and approximately 1.5 wt-% of the total amount of the grease composition; and e) molybdenum disulfide and/or tungsten disulfide in an amount between approximately 0.5 wt-% and approximately 5.0 wt-% of the total amount of the grease composition.

16. The grease composition of claim 1, wherein the amount of the zinc sulfide is between approximately 0.1 wt-% and approximately 2.0 wt-% of a total amount of the grease composition, and the amount of the at least one copper sulfide is between approximately 0.1 wt-% and approximately 1.5 wt-% of the total amount of the grease composition.

17. The grease composition of claim 1, wherein the amount of the zinc sulfide is between approximately 0.2 wt-% and approximately 2.0 wt-% of a total amount of the grease composition, and the amount of the at least one copper sulfide is between approximately 0.2 wt-% and approximately 1.5 wt-% of the total amount of the grease composition.

* * * * *